US010737826B2

(12) United States Patent
Everett

(10) Patent No.: US 10,737,826 B2
(45) **Date of Patent: *Aug. 11, 2020**

(54) CHILD-RESISTANT PACKAGING SYSTEMS AND METHODS

(71) Applicant: Munson Whitman Everett, Lafayette, CA (US)

(72) Inventor: Munson Whitman Everett, Lafayette, CA (US)

(73) Assignee: Sun Grown Packaging, LLC, Oakland, CA (US)

( * ) Notice: Subject to any disclaimer, the term of this patent is extended or adjusted under 35 U.S.C. 154(b) by 105 days.

This patent is subject to a terminal disclaimer.

(21) Appl. No.: 15/724,197

(22) Filed: Oct. 3, 2017

(65) Prior Publication Data

US 2018/0022498 A1 Jan. 25, 2018

Related U.S. Application Data

(63) Continuation of application No. 15/297,942, filed on Oct. 19, 2016, now Pat. No. 9,783,335, which is a (Continued)

(51) Int. Cl.
*B65D 5/38* (2006.01)
*B65D 5/54* (2006.01)

(Continued)

(52) U.S. Cl.
CPC ..... *B65D 5/38* (2013.01); *B65D 5/2057* (2013.01); *B65D 5/22* (2013.01); *B65D 5/541* (2013.01);

(Continued)

(58) Field of Classification Search
CPC ..... B65D 5/38; B65D 59/04; B65D 77/04

(Continued)

(56) References Cited

U.S. PATENT DOCUMENTS 1,253,489 A 1/1918 Houghland
4,101,052 A * 7/1978 Dove ..... B65D 5/0005 206/807

(Continued)

FOREIGN PATENT DOCUMENTS

DE 202008009673 U1 11/2009
EP 0693428 A1 1/1996

(Continued)

OTHER PUBLICATIONS

International Search Report and Written Opinion dated May 5, 2016 in Patent Cooperation Treaty Application No. PCT/US2016/019632 filed Feb. 25, 2016, 11 pages.

(Continued)

*Primary Examiner* — King M Chu
(74) *Attorney, Agent, or Firm* — Carr & Ferrell LLP

(57) ABSTRACT

A child-resistant package is disclosed comprising at least one locking tab, at least one locking slot, the at least one locking slot engaging with the at least one locking tab when the child-resistant package is in a locked position. The at least one locking tab comprising memory properties to allow the at least one locking tab to releasably engage with the at least one locking slot. The at least one locking tab further comprising a corrugated material having flutes oriented in a flute direction and the memory properties including the at least one locking tab returning to the locked position after being in an unlocked position in response to being bent against the flute direction.

28 Claims, 28 Drawing Sheets

Related U.S. Application Data continuation-in-part of application No. 15/053,903, filed on Feb. 25, 2016, now Pat. No. 9,475,605.

(60) Provisional application No. 62/342,739, filed on May 27, 2016, provisional application No. 62/126,048, filed on Feb. 27, 2015.

(51) Int. Cl.
*B65D 5/66* (2006.01)
*B65D 5/20* (2006.01)
*B65D 5/22* (2006.01)

(52) U.S. Cl.
CPC .... *B65D 5/6664* (2013.01); *B65D 2101/0015* (2013.01); *B65D 2215/02* (2013.01); *B65D 2215/06* (2013.01)

(58) Field of Classification Search
USPC ..... 206/1.5, 468
See application file for complete search history.

(56) References Cited

U.S. PATENT DOCUMENTS

| | | | | |
|---|---|---|---|---|
| 4,693,411 | A | 9/1987 | Snyder | |
| 4,844,284 | A | 7/1989 | Drozd et al. | |
| 5,275,291 | A | 1/1994 | Sledge | |
| 6,641,031 | B2 | 11/2003 | Evans et al. | |
| 6,976,576 | B2 | 12/2005 | Intini | |
| 7,275,642 | B2 | 10/2007 | Yuhara | |
| 7,708,142 | B2 | 5/2010 | Ehrlund | |
| 7,757,843 | B2 * | 7/2010 | Katsis | A24F 27/00 206/1.5 |
| 7,854,325 | B2 | 12/2010 | Bentele | |
| 8,304,004 | B2 | 11/2012 | Sanders | |
| 8,342,330 | B2 | 1/2013 | Weston et al. | |
| 8,727,120 | B2 | 5/2014 | Caron et al. | |
| 9,475,605 | B2 | 10/2016 | Everett | |
| 9,783,335 | B2 | 10/2017 | Everett | |
| 2004/0178254 | A1 * | 9/2004 | Ronan | B65D 5/0254 229/153 |
| 2007/0144930 | A1 | 6/2007 | Robson | |
| 2009/0255832 | A1 | 10/2009 | Bentele | |
| 2010/0189961 | A1 | 7/2010 | Bugas et al. | |
| 2011/0108451 | A1 | 5/2011 | Sack et al. | |
| 2011/0289884 | A1 | 12/2011 | Guschke et al. | |
| 2012/0012497 | A1 | 1/2012 | Weston et al. | |
| 2012/0261275 | A1 | 10/2012 | Intini | |
| 2013/0193029 | A1 | 8/2013 | Weston et al. | |
| 2013/0233756 | A1 | 9/2013 | Weston et al. | |
| 2014/0262839 | A1 | 9/2014 | Le et al. | |
| 2016/0251107 | A1 | 9/2016 | Everett | |
| 2017/0036808 | A1 | 2/2017 | Everett | |

FOREIGN PATENT DOCUMENTS

| | | | |
|---|---|---|---|
| EP | 1783058 | A1 | 5/2007 |
| EP | 3261941 | A1 | 1/2018 |
| EP | 3261941 | B1 | 4/2020 |
| GB | 320350 | A | 10/1929 |
| JP | 2012076811 | A | 4/2012 |
| JP | 2012166797 | A | 9/2012 |
| WO | WO2012011941 | A1 | 1/2012 |
| WO | WO2014130941 | A2 | 8/2014 |
| WO | WO2014130941 | A3 | 10/2014 |
| WO | WO2015000896 | A1 | 1/2015 |
| WO | WO2016138305 | A1 | 9/2016 |

OTHER PUBLICATIONS

"Extended European Search Report," European Patent Application No. 16756388.1, dated Jul. 18, 2018, 10 pages.
"Notice of Allowance," European Patent Application No. 16756388.1, dated Oct. 14, 2019, 6 pages.

* cited by examiner

CHILD-RESISTANT PACKAGING SYSTEMS AND METHODS

CROSS-REFERENCE TO RELATED APPLICATIONS

The present U.S. Patent Application is a continuation of U.S. patent application Ser. No. 15/297,942, filed on Oct. 19, 2016, which issued as U.S. Pat. No. 9,783,335 on Oct. 10, 2017, which is a continuation-in-part of U.S. patent application Ser. No. 15/053,903, filed on Feb. 25, 2016, which issued as U.S. Pat. No. 9,475,605 on Oct. 25, 2016, which claims the benefit of U.S. Provisional Patent Application No. 62/126,048, filed on Feb. 27, 2015. U.S. patent application Ser. No. 15/297,942, filed on Oct. 19, 2016 also claims the benefit of U.S. Provisional Patent Application No. 62/342,739, filed on May 27, 2016. All of the aforementioned disclosures are hereby incorporated by reference herein for all purposes including all references cited therein.

FIELD OF THE INVENTION

The present disclosure pertains to packaging, and more specifically, but not by limitation, to systems and methods for child-resistant packaging.

SUMMARY OF THE INVENTION

Some embodiments of the present disclosure may be directed to a child-resistant package. The package may comprise at least one locking tab, at least one locking slot, and the at least one locking slot engaging with the at least one locking tab when the child-resistant package is in a locked position. The at least one locking tab may comprise memory properties to allow the at least one locking tab to releasably engage with the at least one locking slot, the at least one locking tab may further comprise a corrugated material having flutes oriented in a flute direction, and the memory properties being obtained by folding the at least one locking tab against the flute direction. In some embodiments, the against the flute direction may be greater than or equal to 5 degrees relative to the flute direction. In various embodiments, the against the flute direction is substantially perpendicular to the flute direction. In some embodiments, the flutes are at least one of flute size E (295+/−13 flutes per linear meter) and flute size F (420+/−13 flutes per linear meter). In some embodiments, the at least one locking slot is a recessed locking slot. In various embodiments, the package further comprises a support board, the support board supporting the at least one locking tab when the when the child-resistant package is in the locked position. In some embodiments, the package further comprises a tray, a cover, the cover and the tray being formed from a single piece of material, and the at least one locking tab also being formed from the single piece of material.

Various embodiments of the present disclosure may be directed to a child-resistant package. The package may comprise at least one locking tab, at least one locking slot, and the at least one locking slot engaging with the at least one locking tab when the child-resistant package is in a locked position. The at least one locking tab may comprise memory properties to allow the at least one locking tab to releasably engage with the at least one locking slot, the at least one locking tab may further comprise paperboard, the paperboard having a grain, the grain oriented in a grain direction; and the memory properties being obtained by folding the at least one locking tab against the grain direction. In some embodiments, the against the grain direction may be greater than or equal to 5 degrees relative to the grain direction. In various embodiments, the against the grain direction is substantially perpendicular to the grain direction. In some embodiments, thickness of the paperboard is from between 0.012 inches and 0.030 inches. In some embodiments, the at least one locking slot is a recessed locking slot. In various embodiments, the package further comprises a support board, the support board supporting the at least one locking tab when the when the child-resistant package is in the locked position. In some embodiments, the package further comprises a tray, a cover, the cover and the tray being formed from a single piece of material, and the at least one locking tab also being formed from the single piece of material.

Some embodiments of the present disclosure may be directed to a child-resistant package. The package may comprise at least one locking tab, at least one locking slot, and the at least one locking slot engaging with the at least one locking tab when the child-resistant package is in a locked position. The at least one locking tab may comprise memory properties to allow the at least one locking tab to releasably engage with the at least one locking slot, the at least one locking tab may further comprise a corrugated material having flutes oriented in a flute direction. The memory properties may include the at least one locking tab returning to the locked position after being in an unlocked position in response to being bent against the flute direction. In some embodiments, the against the flute direction may be greater than or equal to 5 degrees relative to the flute direction. In various embodiments, the against the flute direction is substantially perpendicular to the flute direction. In some embodiments, the flutes are at least one of flute size E (295+/−13 flutes per linear meter) and flute size F (420+/−13 flutes per linear meter). In some embodiments, the at least one locking slot is a recessed locking slot. In various embodiments, the package further comprises a support board, the support board supporting the at least one locking tab when the when the child-resistant package is in the locked position. In some embodiments, the package further comprises a tray, a cover, the cover and the tray being formed from a single piece of material, and the at least one locking tab also being formed from the single piece of material.

Various embodiments of the present disclosure may be directed to a child-resistant package. The package may comprise at least one locking tab, at least one locking slot, and the at least one locking slot engaging with the at least one locking tab when the child-resistant package is in a locked position. The at least one locking tab may comprise memory properties to allow the at least one locking tab to releasably engage with the at least one locking slot, the at least one locking tab may further comprise paperboard, the paperboard having a grain, the grain oriented in a grain direction. The memory properties may include the at least one locking tab returning to the locked position after being in an unlocked position in response to being bent against the grain direction. In some embodiments, the against the grain direction may be greater than or equal to 5 degrees relative to the grain direction. In various embodiments, the against the grain direction is substantially perpendicular to the grain direction. In some embodiments, thickness of the paperboard is from between 0.012 inches and 0.030 inches. In some embodiments, the at least one locking slot is a recessed locking slot. In various embodiments, the package further comprises a support board, the support board supporting the at least one locking tab when the when the child-resistant package is in the locked position. In some embodiments, the package further comprises a tray, a cover, the cover and the tray being formed from a single piece of material, and the at least one locking tab also being formed from the single piece of material.

In various embodiments, the material of the child-resistant packaging may be a paper-based product including paperboard (also known as cardboard, carton board, and solid board) and corrugated paperboard (also known as corrugated board, corrugated cardboard, and corrugated fiberboard).

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments. The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Various embodiments of the present technology are made by die cutting. A person of ordinary skill in the art understands die cutting is a manufacturing process used to generate a large number of the same shape from a material. Non-limiting examples of a material include wood, metal, paper, plastic, and combinations thereof. A die cut shape may be called a blank as referenced herein.

DETAILED DESCRIPTION

Figure 1:
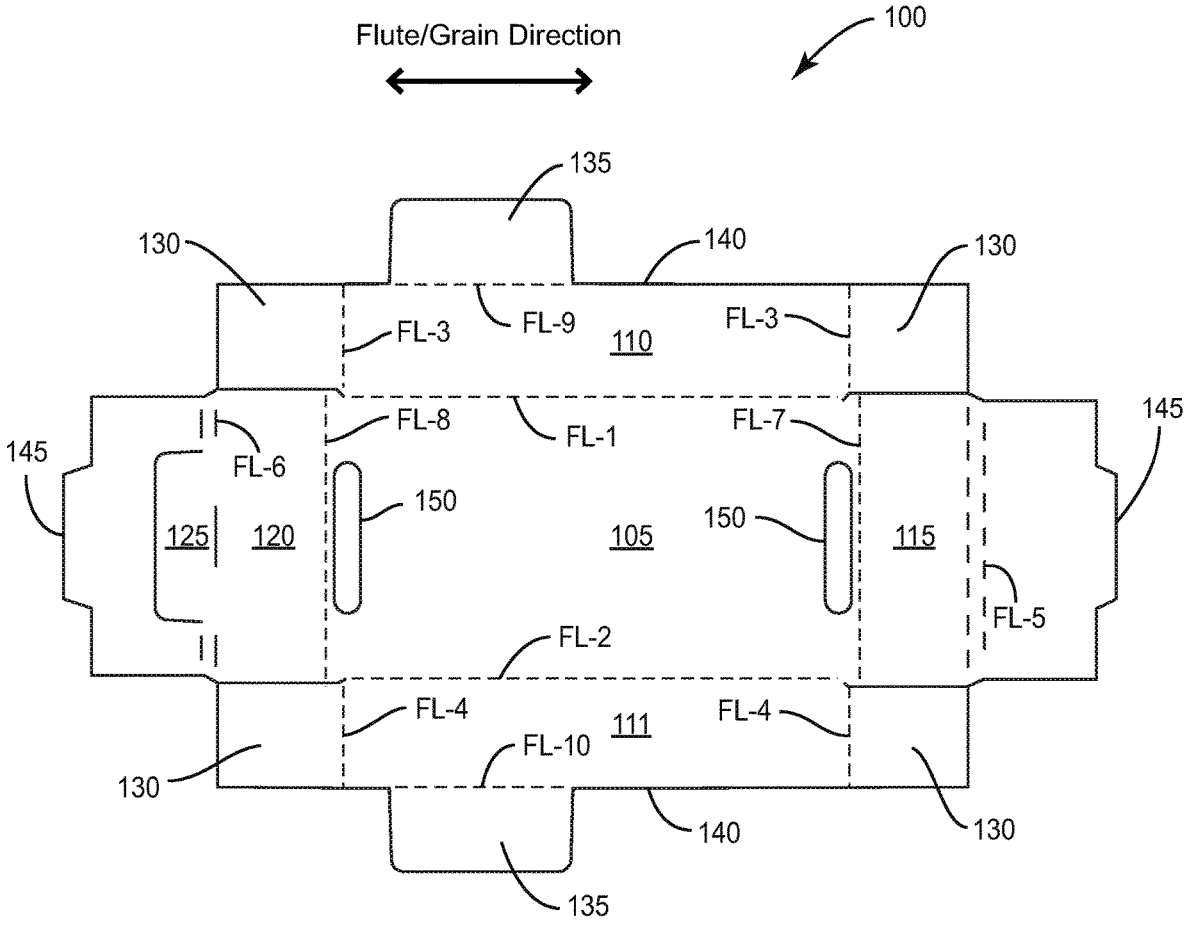
FIG. 1 is a plan view of an inner tray blank, according to various embodiments.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, steps, operations, elements, and/or components, but do not preclude the presence or addition of one or more other features, steps, operations, elements, components, and/or groups thereof. It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Packaging for age-sensitive content requires special features such as child-resistance. A package is child-resistant if a person of inappropriate age (e.g., a child five-years-old or younger) cannot open the package, while a person of appropriate age (e.g., an adult) can conveniently open the same package. For example, a child-resistant package is locked to a five-year-old child, while being efficiently unlocked by an adult including seniors. A child-resistant package results in the contents (e.g., pharmaceuticals, medicines, etc.) of the package not being accessible to a person of inappropriate age, while being accessible to a person of appropriate age. For example, a pharmaceutical in a child-resistant package is not accessible to a five-year-old child, while being easily accessible to an adult. Various standards exist for child-resistant packaging, such as the Consumer Product Safety Commission's standards and protocols for poison prevention packaging, as set forth in the Code of Federal Regulations Title 16, Part 1700.20. Additional child-resistant packaging standards may be found in the Federal Insecticide, Fungicide, and Rodenticide Act (FIFRA) section 25 (c)(3), located at 40 Code of Federal Regulations 157 subpart B. Additionally, standards development organizations such as American Society for Testing and Materials (ASTM) International develops and maintains standard test methods and procedures for child-resistant packages. Various embodiments of the present technology meet the standards for poison prevention packaging according to C.F.R. Title 16, Part 1700.20. For example, after testing various embodiment of the present technology under C.F.R. Title 16, Part 1700.20, 0 children out of 50 child panelists were successful in opening the package before demonstration and 0 children were successful in opening the package following a demonstration for a total of 0 successful child panelists. This represents a child-resistant effectiveness of 100%. Furthermore, a total of 25 of the 25 seniors in the 50 to 54 year old age group were successful in opening the first package and opening and properly closing the second package, 25 of the 25 seniors in the 55 to 59 year old age group were successful, and 50 of the 50 seniors were successful in the 60 to 70 year old age group. In summary, embodiments of the present technology fulfill requirements for poison prevention packaging according to Code of Federal Regulations Title 16, Part 1700.20.

Additional features of a child-resistant package include durability so the child-resistant package can be opened and closed (i.e., locked and unlocked) many times while maintaining child-resistance.

Various embodiments of the present disclosure may comprise child-resistant features for packaging. Child-resistance may be enabled by "memory" properties of the material used to make the child-resistant packaging. "Memory" properties are characteristics that enable locking and unlocking (i.e., opening and closing) of a child-resistant package (hereinafter Memory Properties). In some embodiments, the material with Memory Properties may comprise a paper-based product including, but not limited to, paperboard, corrugated paperboard, and the like. In various embodiments, the material with Memory Properties may comprise synthetic materials such as plastics, polymers, and the like. For example, plastic materials include products such as Polypropylene (PP), Polyethylene (PE), Polyvinylchloride (PVC), Polyesterterephtalate (PET), and Polylactic acid (PLA) that may be made from renewable sources. In still further embodiments, the material with Memory Properties may comprise more than one type of material, such as a combination of paper and plastic materials. In various embodiments, the material may be any material with Memory Properties.

In various embodiments, the present technology of child-resistant packaging is made from paper, paperboard, corrugated paperboard, heavy solid board, and semi-rigid plastics. A person of ordinary skill in the art understands that paper is a fiber-based material produced from wood, rags, or other organic material. A person of ordinary skill in the art understands paperboard is the name for a range of paper based materials that includes but is not limited to folding box board (FBB), solid bleached board (SBB), solid unbleached board (SUB), white lined chipboards (WLC), some unlined chipboards, and certain laminated boards. A person of ordinary skill in the art understands corrugated paperboard is manufactured by combining lining paper with a fluting medium in a unit called a single facer. The liners used may be made from recycled, test, or kraft papers, and consequently may have a brown or white surface, which may be coated or semi-coated, depending on the application for which they are used. The fluting medium may be recycled paper. For example, in the single facer unit, heat, steam, and a corrugating roller may be used to corrugate the fluting medium, which then has the liner attached. This creates single face, the basic building block of all corrugated board. Single face may be used 'as is' for some specific applications and also may be combined with further liners and fluting media to produce single wall corrugated (single face plus a top liner), double wall (single wall plus single face), or multi-wall (further combinations of the above). The thickness of the corrugated material will depend on the fluting height created by the single facer and the combination of flutings used. The non-limiting range of thicknesses may vary from 0.5 mm for the finest, up to 15 mm for the thickest, and sometimes more.

In exemplary embodiments of the present disclosure, the material with Memory Properties may be corrugated paperboard (also known as corrugated board, corrugated cardboard, and corrugated fiberboard). As understood by a person of ordinary skill in the art, corrugated paperboard is a paper-based material made from a fluted corrugated sheet and flat linerboard(s) (usually one or two flat linerboards). The fluted corrugated sheet may have sheets of different sizes that refer to the number of flutes per liner foot or flutes per linear meter. Common flute sizes are "A," "B," "C," "D," "E," "F," "G," "N" and microflute where the letter designation indicates flute size. A person of ordinary skill in the art recognizes that flute size refers to the number of flutes per linear meter and various flute thicknesses, although the actual flute dimensions for different manufacturers may vary. A person of ordinary skill in the art understands the following flute sizes: flute size "A" is approximately 108+/−10 flutes per linear meter, flute size "B" is approximately 154+/−10 flutes per linear meter, flute size "C" is approximately 128+/−10 flutes per linear meter, flute size "D" approximately is 208+/−13 flutes per linear meter, flute size "E" is approximately 295+/−13 flutes per linear meter, flute size "F" is approximately 420+/−13 flutes per linear meter, flute size "G" is approximately 550+/−13 flutes per linear meter, flute size "N" is approximately 572+/−13 flutes per linear meter, and microflute (also known as "E"). Significantly, the direction of the flutes in the corrugated sheet gives the corrugated paperboard unique properties when it is folded. For example, folding a corrugated sheet against the flute direction (i.e., the direction the flutes run) gives the corrugated sheet Memory Properties such that the sheet tends to return to its original pre-bended shape. In some embodiments, against the flute direction is essentially perpendicular to the flute direction. In various embodiments, against the flute direction is greater than or equal to five degrees relative to the flute direction. Any folding and/or bending of a corrugated sheet that is not in the same direction as the flute direction is against the flute direction. Thus, proper selection of the flute size and corrugated construction can impart spring-like properties (i.e., Memory Properties) to the material. Some embodiments of child-resistant packaging have optimal Memory Properties with memory tabs made from corrugated paperboard with "A," "B," "C," and "D," flute size. Some embodiments of child-resistant packaging have optimal Memory Properties with memory tabs (i.e., locking tabs) made from corrugated paperboard with "E" and "F."

In various embodiment of the present technology, corrugated paperboard may be specified by the construction and/or flute size as well as other characteristics. The choice of corrugated medium, flute size, combining adhesive, and linerboards (e.g., single face, single wall, double wall, etc.) can be varied to engineer a corrugated board with specific properties including but not limited to burst strength, edge crush strength, flat crush, basis weights of components (pounds per thousand square feet, grams per square meter, etc.), and surface treatments, coatings, and the like. The properties of corrugated paperboard can be engineered to match a wide variety of uses including the requirements for the contents of a child-resistant package such as temperature tolerance, crush resistance, durability, strength, and the like. For example, the contents of a child-resistant package may require storage in a freezer so the corrugated paperboard may be designed with surface treatment and coating to tolerate cold temperatures. As understood by a person of ordinary skill in the art, strength of corrugated matter may be determined by the Bursting Test (also known as the Mullen Test), which is related to the rough handling durability of corrugated material. The Bursting Test is a measure of the force required to rupture or puncture the face of corrugated board and may be measured by a Mullen Tester. This force is indirectly related to the ability of a carton made from corrugated material to withstand external or internal forces and thus to contain and protect a product during shipment. For example, bursting strength is reported in pounds. For example, bursting strength of 275 pounds is 275#. Some embodiments of the present technology have optimal Memory Properties with memory tabs (i.e., locking tabs) made from 31#, 35# and 42# corrugated paperboard.

In exemplary embodiments of the present technology, the material with Memory Properties may be paperboard (also known as cardboard, carton board, and solid board). As understood by a person of ordinary skill in the art, the direction of fibers in a sheet of paperboard is generated during paperboard formation. As paperboard moves forward along the forming wire on a papermaking machine, the fibers align themselves in a direction parallel to the direction of wire travel through the machine (also called machine direction). When paperboard is cut into sheets, the sheets will be either long-grain (or grain-long) if the fibers are aligned parallel to a sheet's longer dimension, or short-grain (or grain-short), if the fibers are aligned parallel to a sheet's shorter dimension. Paperboard will tear and fold more easily with the grain and with greater difficulty against the grain. For example, folding a paperboard sheet against the direction of the grain gives the paperboard sheet Memory Properties such that the paperboard sheet tends to return to its original pre-bended shape. In some embodiments, against the grain direction is essentially perpendicular to the grain direction. In various embodiments, against the grain direction is greater than or equal to five degrees relative to the grain direction. Any folding and/or bending of a corrugated sheet that is not in the same direction as the direction of fibers in a sheet of paperboard is against the grain direction. Thus, folding a paperboard sheet against the grain can impart spring-like properties (i.e., Memory Properties) to the paperboard sheet.

In various embodiments paperboard used for the present technology is selected for its Memory Properties. As understood by a person of ordinary skill in the art, in the United States thickness (also referred to as "caliper") is usually expressed in thousandths of an inch (0.001") or points (pt), where a sheet of paperboard with a thickness of 0.024" would be 24 points. For example, non-limiting thickness of various embodiments are 12 pt to 40 pt (and higher). Some embodiments of child-resistant packaging have optimal Memory Properties with memory tabs (i.e., locking tabs) made from paperboard 12 pt to 30 pt.

Figure 9:
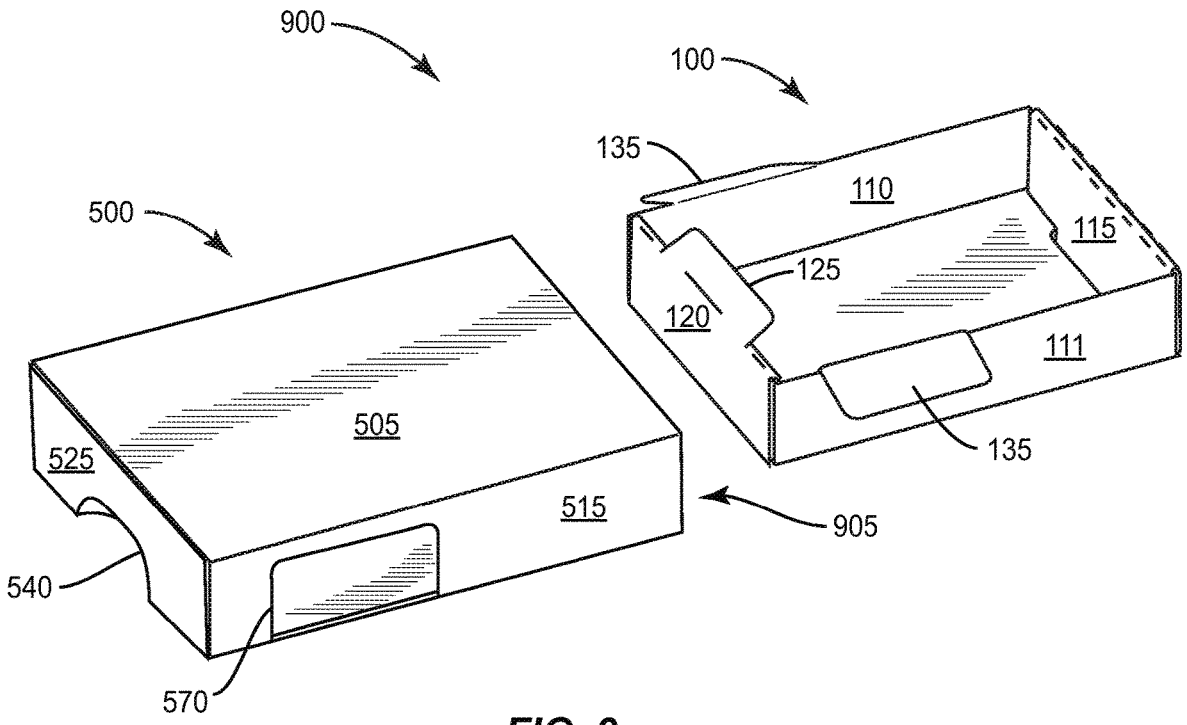
FIG. 9 is a perspective view of an inner tray and an outer sleeve, according to various embodiments.

Various embodiments of the present disclosure may comprise a child-resistant package comprising an inner tray, an outer sleeve to contain the inner tray, and an engageable/ disengageable locking system to secure the inner tray within the outer sleeve (see, for example, FIG. 9). FIG. 1 illustrates an exemplary die cut blank for an inner tray 100. The precise overall shape of the blank, as well as the precise shape of each component of the blank, may be varied for each particular use of the child-resistant package, as well as for design aesthetics. One skilled in the art will readily recognize that the shapes and specific components illustrated in this disclosure for the blanks may have significant variability without departing from the scope of the disclosure. The die cut blank of FIG. 1 may comprise a floor panel 105. The floor panel 105 may be coupled to opposing first side wall 110 and second side wall 111 along fold lines FL-1 and FL-2, respectively. At each end of the first side wall 110, end tabs 130 may be coupled along fold lines FL-3. Similarly, end tabs 130 may be coupled to the second side wall 111 along fold lines FL-4. Along an edge 140 of each of the first and second side walls 110, 111 (which will become an upper edge 140 of the inner tray 100 as will become evident in the discussion below), at least one locking tab 135 may be coupled along fold lines FL-9 and FL-10, respectively. The floor panel 105 may also be coupled to opposing first end panel 115 and second end panel 120 along fold lines FL-7 and FL-8, respectively. Each of the first end panel 115 and second end panel 120 may be divided approximately in half by fold lines FL-5 and FL-6, respectively. The second end panel 120 may further comprise a first tethering panel 125 at least partially cut from the second end panel 120 and coupled to the end panel 120 in proximity to the fold line FL-6. Each of the first and second end panels 115, 120 may terminate with a tab 145 adapted to engage slot 150 in the floor panel 105 as described in further detail below. A bi-directional arrow labeled "Flute/Grain Direction" shows the flute direction for corrugated material and the grain direction for paperboard, according to various embodiments of the present technology. In various embodiments for corrugated material, the locking tabs 135 are folded along fold lines FL-9 and FL-10 resulting in the locking tabs folding against the flute direction for the corrugated material. In various embodiments for paperboard, the locking tabs 135 are folded along fold lines FL-9 and FL-10 resulting in the locking tabs folding against the grain direction for the paperboard.

Figure 2:
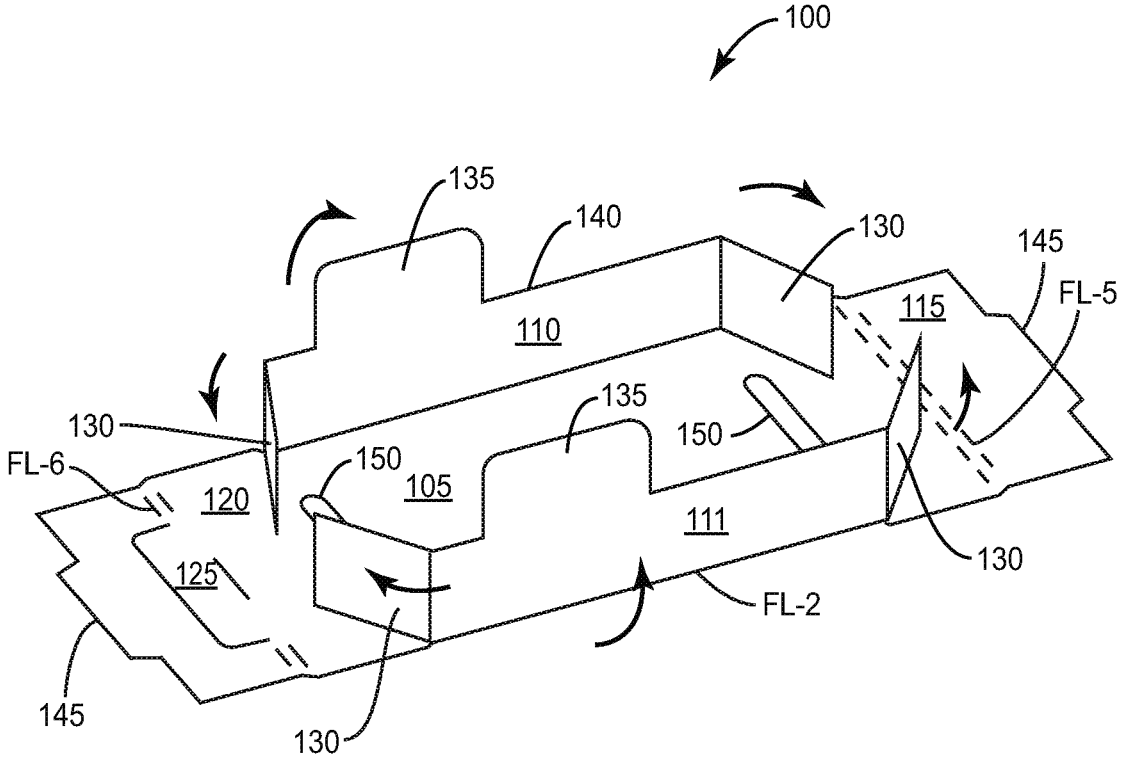
FIG. 2 is a perspective view of an inner tray blank being formed into an inner tray, according to various embodiments.
Figure 3:
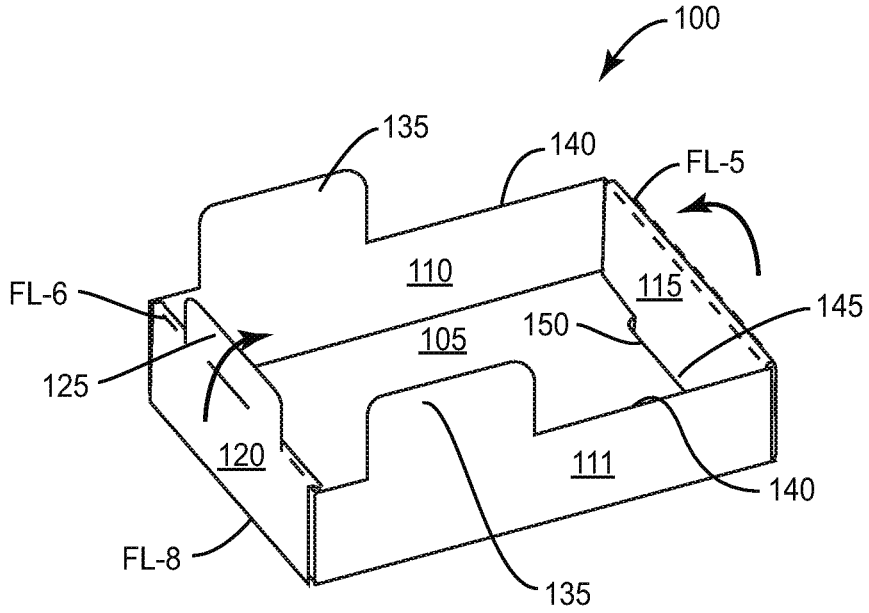
FIG. 3 is a perspective view of an inner tray blank being formed into an inner tray, according to some embodiments.
Figure 4:
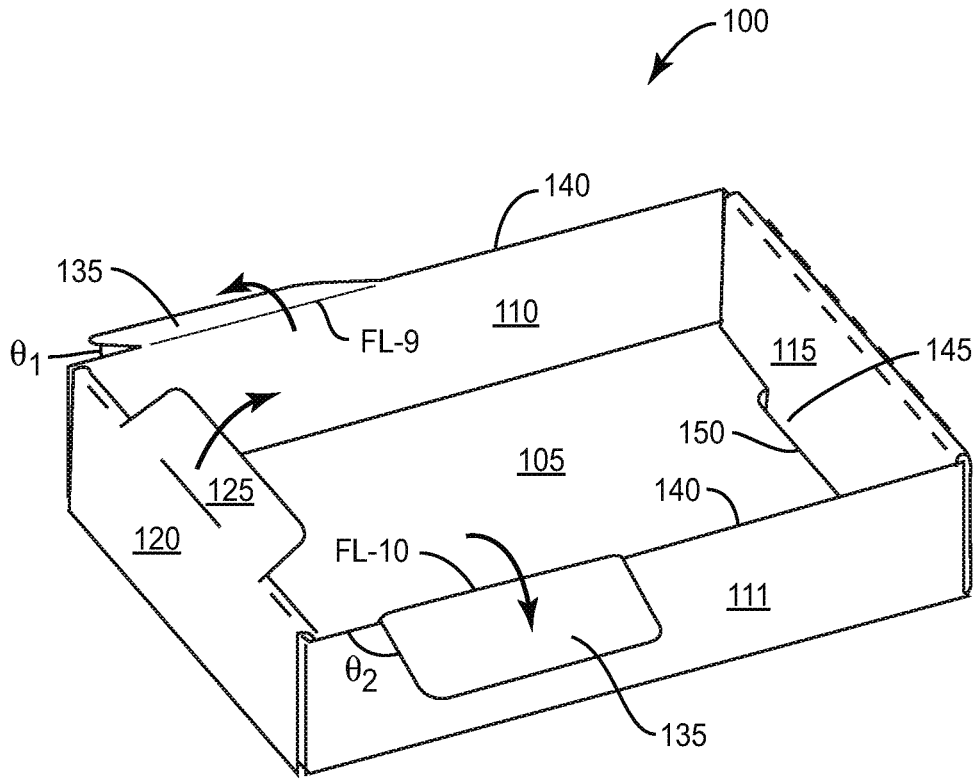
FIG. 4 is a perspective view of an inner tray blank being formed into an inner tray, according to various embodiments.

FIGS. 2-4 illustrate assembly of the inner tray 100 according to various embodiments. In FIG. 2, the first and second side walls 110, 111 may be folded along fold lines FL-1 and FL-2 so that the first and second side walls 110, 111 are substantially perpendicular to the floor panel 105. All four of the end tabs 130 may be folded inward along fold lines FL-3 and FL-4 towards the floor panel 105 so that the end tabs 130 are substantially perpendicular to the first and second side walls 110, 111 and substantially parallel to the first and second end panel fold lines FL-7, FL-8.

Referring now to FIG. 3, the first end panel 115 may be folded along fold line FL-7 and then along fold line FL-5 such that the end tabs 130 are contained within the folded over halves of the first end panel 115. The tab 145 may then be inserted into the slot 150 to secure the first end panel 115 in an upright position substantially perpendicular to the floor panel 105, as well as securing two of the end tabs 130 within the folded over halves of the first end panel 115. Similarly, the second end panel 120 may be folded along fold line FL-8, then again along fold line FL-6. The remaining two end tabs 130 may be contained within the folder over halves of the second end panel 120. The tab 145 may then be inserted into the slot 150 to secure the second end panel 120 in an upright position substantially perpendicular to the floor panel 105, as well as securing two of the end tabs 130 within the folded over halves of the second end panel 120. When the second end panel 120 is secured in this position, the first tethering panel 125 may be positioned in a substantially vertical position. In various embodiments, the first tethering panel 125 may be angled towards the first end panel 115.

Turning now to FIG. 4, the edge 140 of the first and second side walls 110, 111 may now form at least a portion of the upper edge 140 of the inner tray 100. The locking tabs 135 may be folded along fold lines FL-9 and FL-10 towards the outside of the inner tray 100 such that the locking tabs 135 are angularly disposed to the first and second side walls 110, 111. The locking tabs 135 may be oriented at an angle $\theta_1$, $\theta_2$ to the first and second side walls 110, 111, respectively. The angles $\theta_1$, $\theta_2$ may range from about 0° to about 90°.

Figure 5:
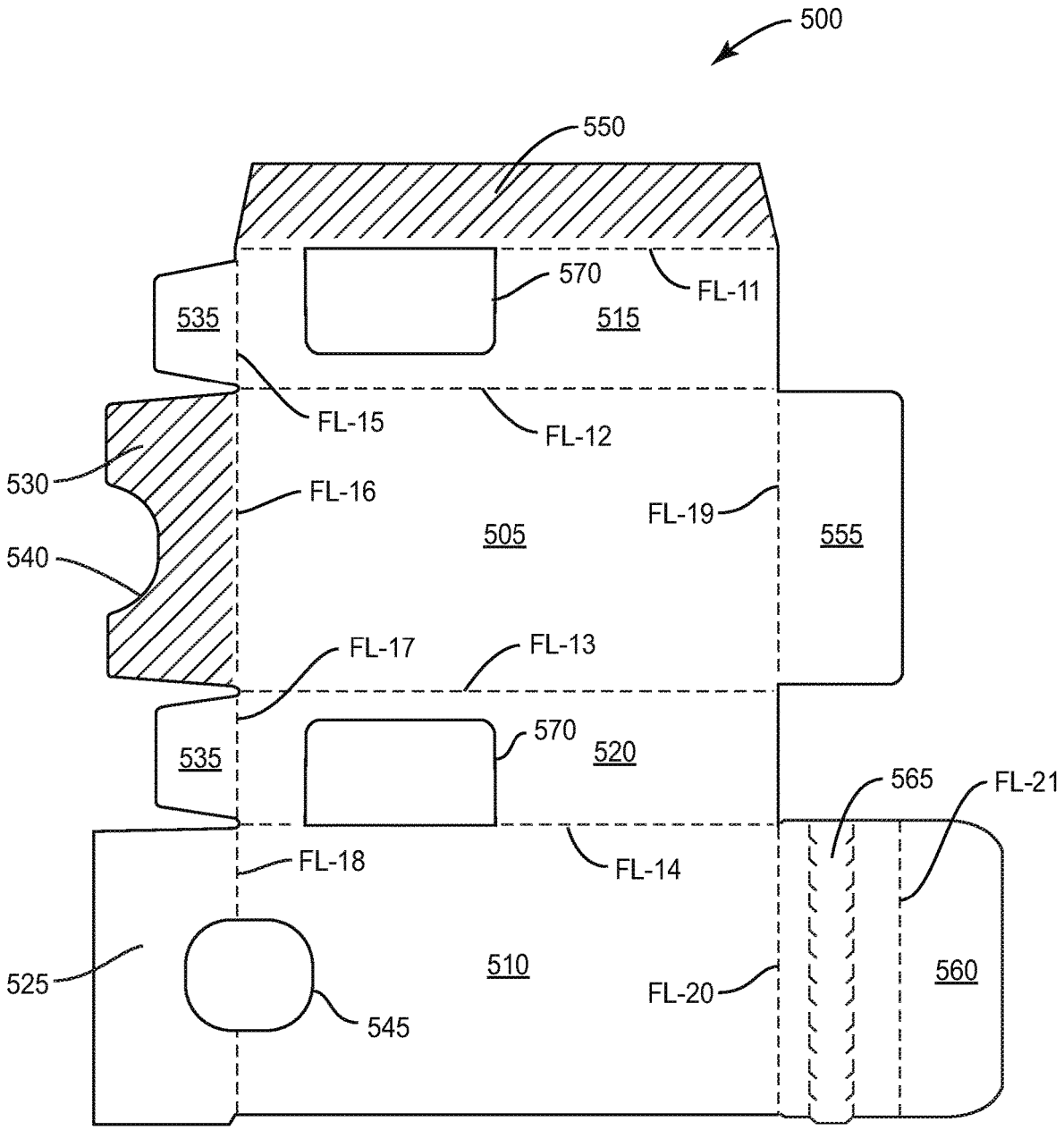
FIG. 5 is a plan view of an outer sleeve blank, according to various embodiments.

FIG. 5 illustrates an exemplary die cut blank for an outer sleeve 500. The precise overall shape of blank, as well as the precise shape of each component of the blank, may be varied for each particular use of the child-resistant package, as well as for design aesthetics. One skilled in the art will readily recognize that the shapes and specific components illustrated in this disclosure for the blanks may have significant variability without departing from the scope of the disclosure. The die cut blank of FIG. 5 may comprise an upper panel 505. A first side wall 515 may be coupled to one side of the upper panel 505 along fold line FL-12, and a second side wall 520 may be coupled to the upper panel 505 along fold line FL-13 on a side of the upper panel 505 opposite from the first side wall 515. A sealing tab 550 may be coupled to a side of the first side wall 515 along fold line FL-11 opposite the upper panel 505. The function of the sealing tab 550 will be described in further detail below. A lower panel 510 may be coupled on an opposing side of the second side wall 520 from the upper panel 505 along fold line FL-14. A first end panel 525 may be coupled to a side of the lower panel 510 along fold line FL-18. A front panel 560 may be coupled on an opposing side of the lower panel 510 from the first end panel 525 along fold line FL-20. The front panel 560 may comprise a tamper resistant feature 565 (for example, a tear away strip) that provides a visual indication that the outer sleeve 500 has been opened or at least tampered with. The front panel 560 may further comprise fold line FL-21 to facilitate sealing an end of the outer sleeve 500 by the front panel 560 as described below. A second end panel 530 may be coupled to a side of the upper panel 505 along fold line FL-16. A second tethering panel 555 may be coupled on an opposing side of the upper panel 505 from the second end panel 530 along fold line FL-19. End panel tabs 535 may be coupled to an end of the each of the first and second side walls 515, 520 along fold line FL-15 and FL-17 in proximity to the second end panel 530. The first end panel 525 may comprise an engagement point 545 which may comprise an opening positioned at least partially in the first end panel 525. The second end panel 530 may comprise a corresponding tamper resistant feature 540 that aligns with the engagement point 545 when the outer sleeve 500 is assembled. The tamper resistant feature 540 may comprise a portion of the second end panel 530 that is scored, but not removed from the second end panel. Thus, if the tamper resistant feature 540 is missing, it may serve as an indication that the package was tampered with. Each of the first and second side walls 515, 520 may comprise locking slots 570, which may comprise voids in the first and second side walls 515, 520 adapted to receive the locking tabs 135 of the inner tray 100 therein. The cross-hatched area of the blank indicates areas where an adhesive, a glue, an adhesive strip, or other chemical or mechanical attachment mechanism may be employed to assemble the outer sleeve 500 in a manner to achieve child-resistant guidelines and standards.

Figure 6:
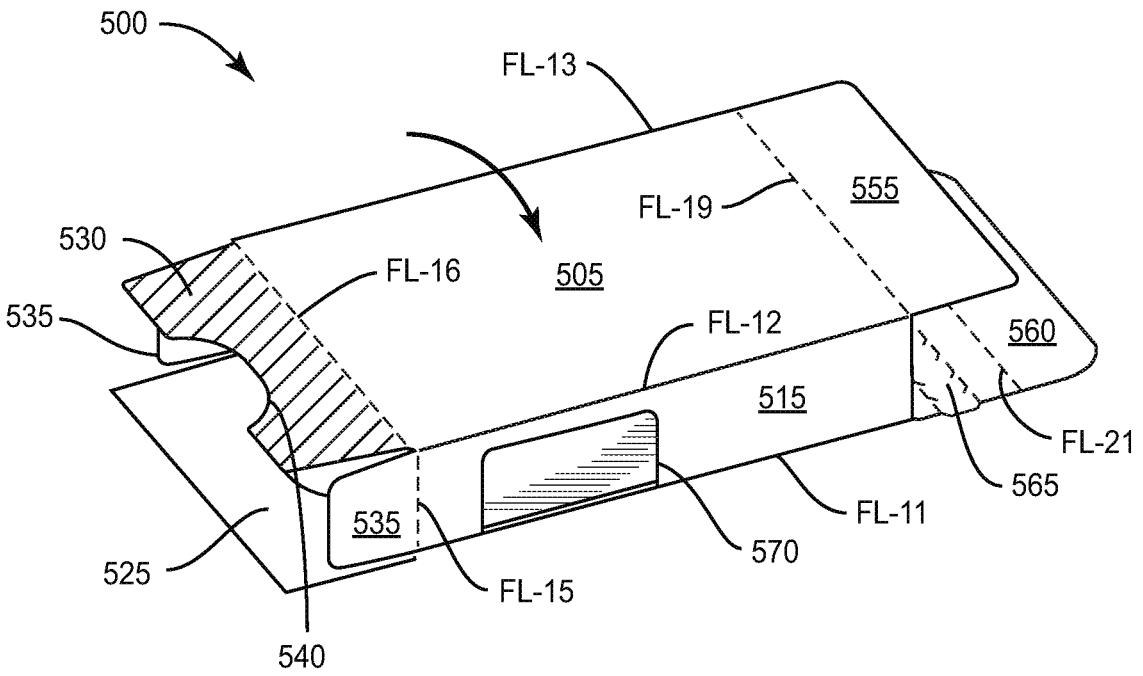
FIG. 6 is a perspective view of an outer sleeve blank being formed into an outer sleeve, according to various embodiments.
Figure 7:
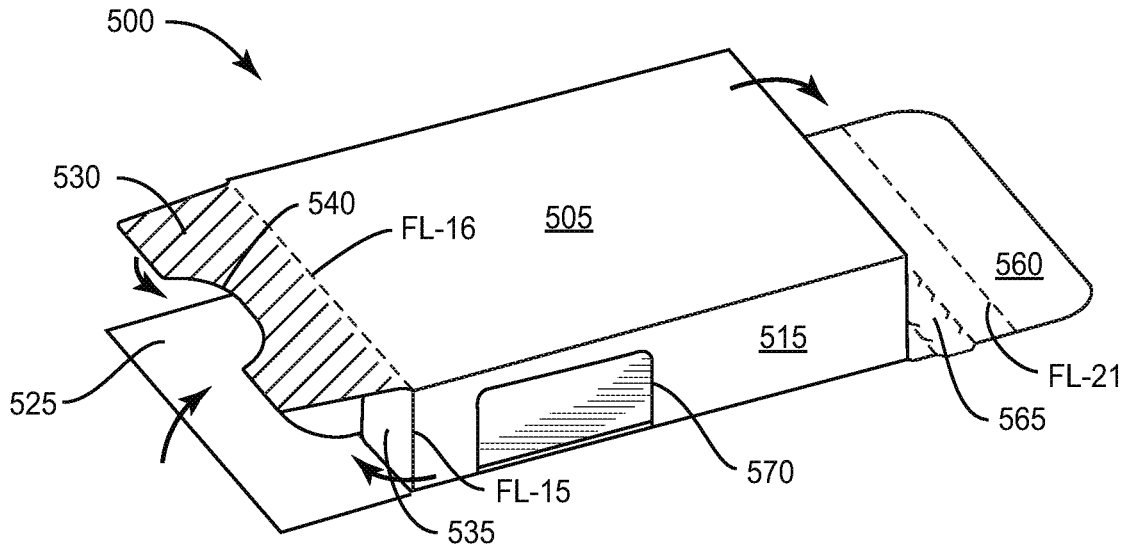
FIG. 7 is a perspective view of an outer sleeve blank being formed into an outer sleeve, according to various embodiments.
Figure 8:
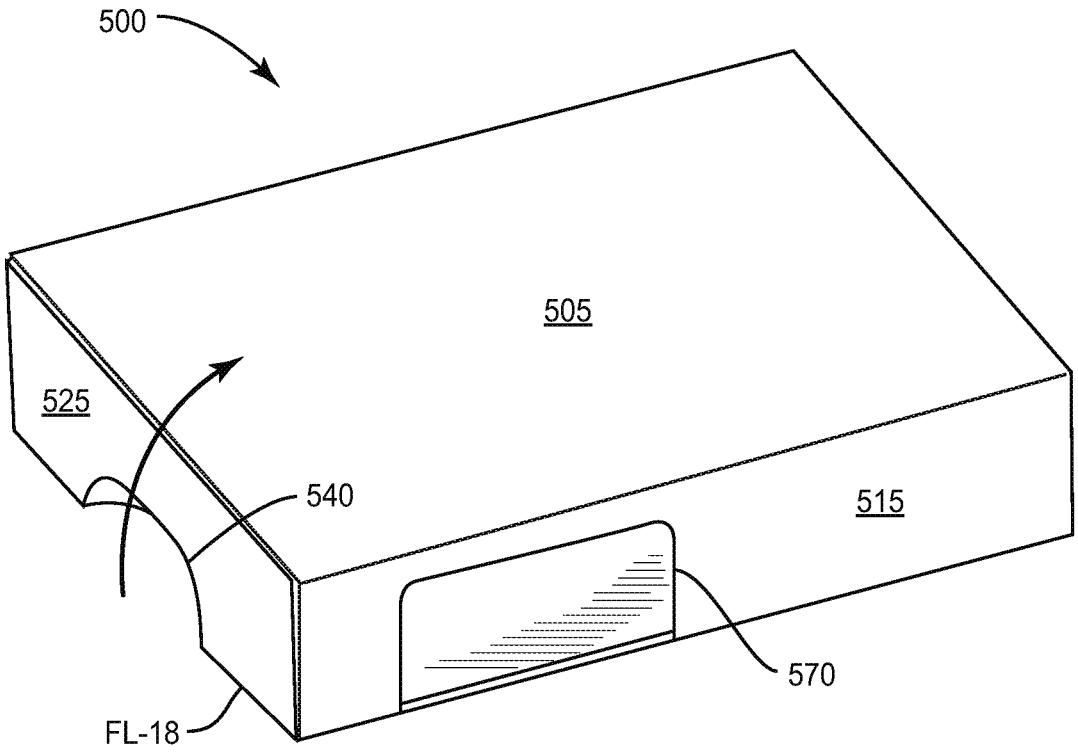
FIG. 8 is a perspective view of an outer sleeve, according to various embodiments.

FIGS. 6-8 illustrate assembly of the outer sleeve 500 according to various embodiments. In FIG. 6, the die cut of FIG. 5 may be folded along fold lines FL-12, FL-13, and FL-14 such that substantially right angles are formed at each fold line and the upper panel 505, lower panel 510, first side wall 515, and second side wall 520 form an essentially box-like structure open at each end. Although not visible in the view of FIG. 6, the sealing tab 550 may be folded along fold line FL-11 so that it makes contact with the lower panel 510 at the cross-hatched area (see FIG. 5) and is secured in place (e.g., by an adhesive).

Referring now to FIG. 7, the first end panel 525 may be folded along fold line FL-18 such that the first end panel 525 essentially covers one of the open ends of the box-like structure. Each of the end panel tabs 535 may then be folded along fold lines FL-15 and FL-17 such that the end panel tabs 535 contact the first end panel 525 and are secured in place (e.g., by an adhesive). The second end panel 530 may then be folded along fold line FL-16 (see FIG. 8) such that the second end panel 530 contacts and covers the end panel tabs 535 and the first end panel 525 and is secured in place (e.g., by an adhesive). After the inner tray 100 is inserted into the assembled outer sleeve 500 (see, for example, FIG. 12), the front panel 560 may be folded along fold line FL-20 and fold line FL-21 such that the opening in the box-like structure adjacent to the front panel 560 is covered as illustrated in FIG. 8. A portion of the front panel 560 may contact the upper panel 505 and may be secured in place (e.g., by an adhesive).

The second tethering panel 555 as illustrated in FIG. 6 may be folded along fold line FL-19 as illustrated in FIG. 7 such that the second tethering panel 555 is positioned inside the box-like structure of the outer sleeve 500 and is angularly disposed toward the first and second end panels 525, 530.

Figure 10:
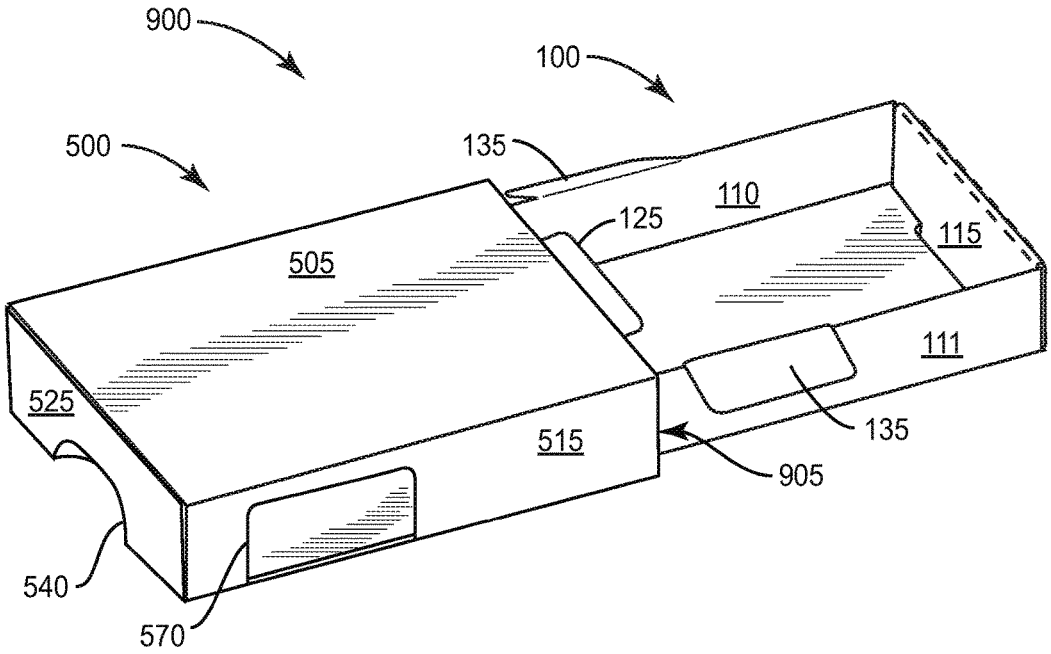
FIG. 10 is a perspective view of an inner tray partially inserted into an outer sleeve, according to various embodiments.

Turning now to FIGS. 9-12, operation of the child-resistant package 900 is illustrated according to various embodiments. FIGS. 9-12 assume that the child-resistant package 900 has been initially opened and the front panel 560 has been removed from the outer sleeve 500. The child-resistant package 900 as illustrated in FIG. 9 may comprise the outer sleeve 500 and the inner tray 100 adapted to slideably engage the outer sleeve 500. The outer sleeve 500 may comprise an opening 905 defined by the first and second side walls 515, 520 and the upper panel 505 and the lower panel 510. The inner tray 100 may be sized to fit into the opening 905 as illustrated in FIG. 10 with little or no clearance. That is, the inner tray 100 may contact one or more of the first and second side walls 515, 520 and the upper panel 505 and the lower panel 510 of the outer sleeve 500 when inserted into the outer sleeve 500, but is still able to repeatedly slide back and forth. While the fit of the inner tray 100 and the outer sleeve 500 may be considered "tight," the lack or near lack of clearance does not prevent sliding movement of the inner tray 100.

Figure 11:
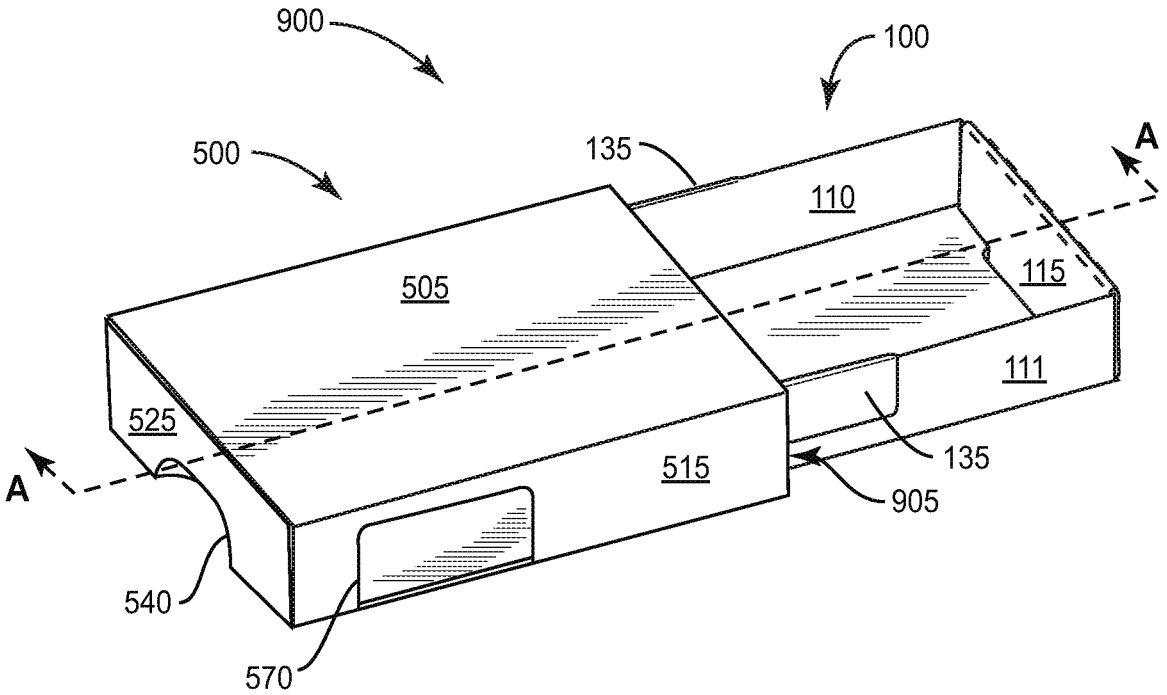
FIG. 11 is a perspective view of an inner tray partially inserted into an outer sleeve, according to various embodiments.

As the inner tray 100 is engaged further into the outer sleeve 500, the locking tabs 135, which as described previously angularly extend outward from the inner tray first and second side walls 110, 111, may contact the outer sleeve first and second side walls 515, 520 due to this angular positioning. Thus, as illustrated in FIG. 11, the locking tabs 135 may be folded flat against the inner tray first and second side walls 110, 111 to allow the inner tray 100 to continue to engage the outer sleeve 500. At this point, the locking tabs 135 may remain sandwiched between outer sleeve first and second side walls 515, 520 and the inner tray first and second side walls 110, 111 until the inner tray 100 is fully engaged with the outer sleeve 500.

Figure 12:
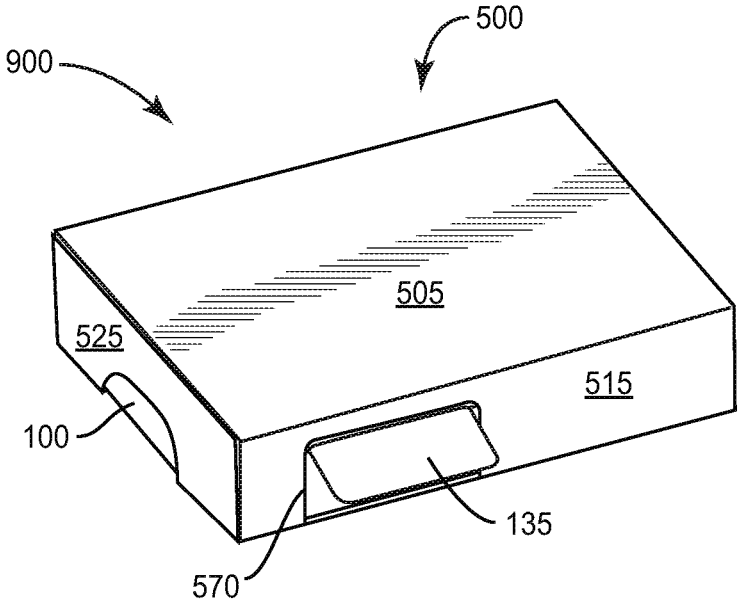
FIG. 12 is a perspective view of an inner tray inserted into an outer sleeve, according to various embodiments.

Once the inner tray 100 is fully engaged with the outer sleeve 500, the locking tabs 135 may align with the locking slots 570 in the outer sleeve first and second side walls 515, 520. Owing to the Memory Properties of the locking tabs 135, the locking tabs 135 may spring back to the previous angular orientation once aligned with the locking slots 570 as illustrated in FIG. 12. With the locking tabs 135 thus oriented in the locking slots 570, the inner tray 100 may be releasably locked within the outer sleeve 500. According to various embodiments, the locking system is operative without user intervention (other than sliding the inner tray 100 into the outer sleeve 500) by utilizing the Memory Properties of the locking tabs 135.

Figure 13:
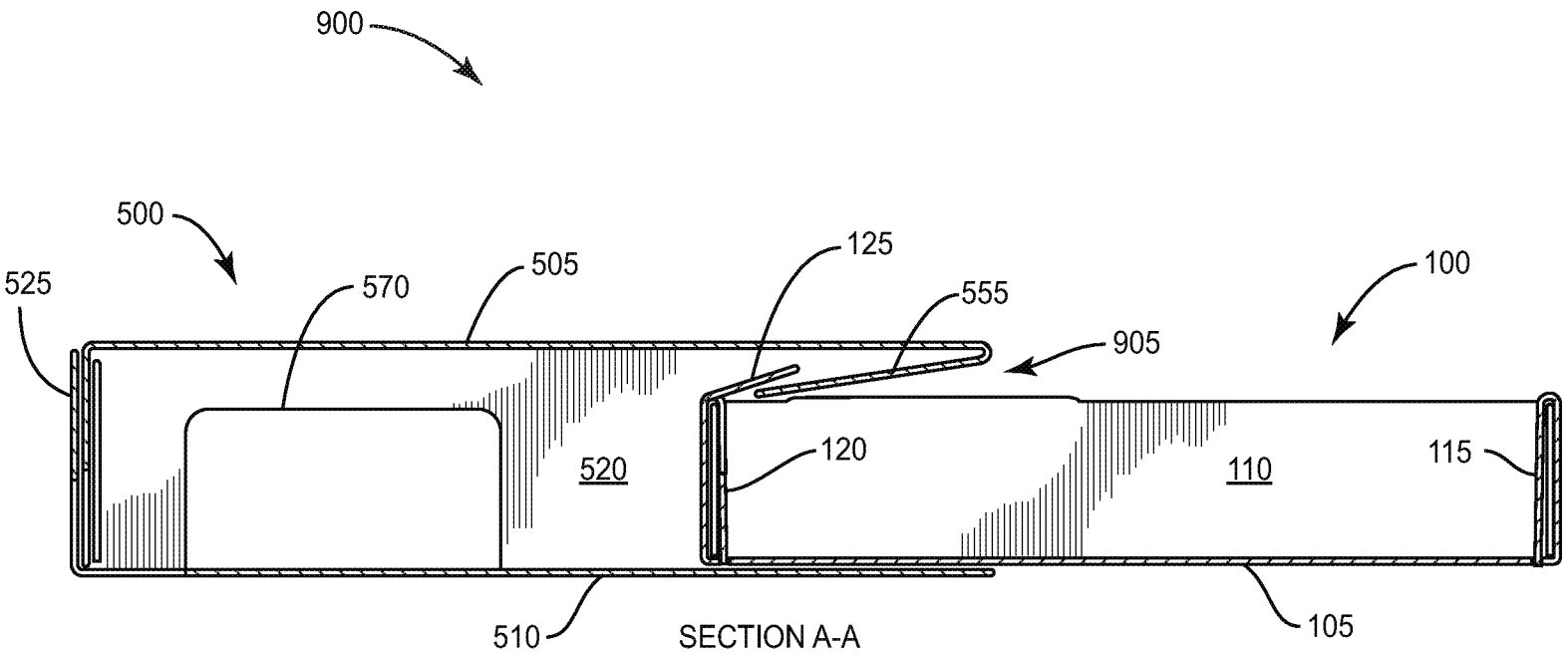
FIG. 13 is a cross-section view of a child-resistant package, according to various embodiments.

As described previously, the inner tray 100 may comprise a first tethering panel 125 and the outer sleeve 500 may comprise a second tethering panel 555. The first and second tethering panels 125, 555 may act with one another to prevent complete removal of the inner tray 100 from the outer sleeve 500 after the inner tray 100 has been initially engaged with the outer sleeve 500. The first tethering panel 125 may extend vertically upward or angularly upward from the inner tray 100, and the second tethering panel 555 may extend downward from the outer sleeve upper panel 505 in proximity to the opening 905 as illustrated in the cross-sectional view of FIG. 13 (section A-A from FIG. 11). As the inner tray 100 slides forward and outward from the outer sleeve 500, the first and second tethering panels 125, 555 may contact one another, thereby arresting further forward (outward) movement of the inner tray 100. The first and second tethering panels 125, 555 act to prevent complete removal of the inner tray 100 from the outer sleeve 500. However, the first and second tethering panels 125, 555 do not prevent the inner tray 100 from sliding inward back into a fully engaged position within the outer sleeve 500 so that the locking tabs 135 may again engage the locking slots 570 and return the child-resistant package 900 to a releasably locked state.

Figure 14:
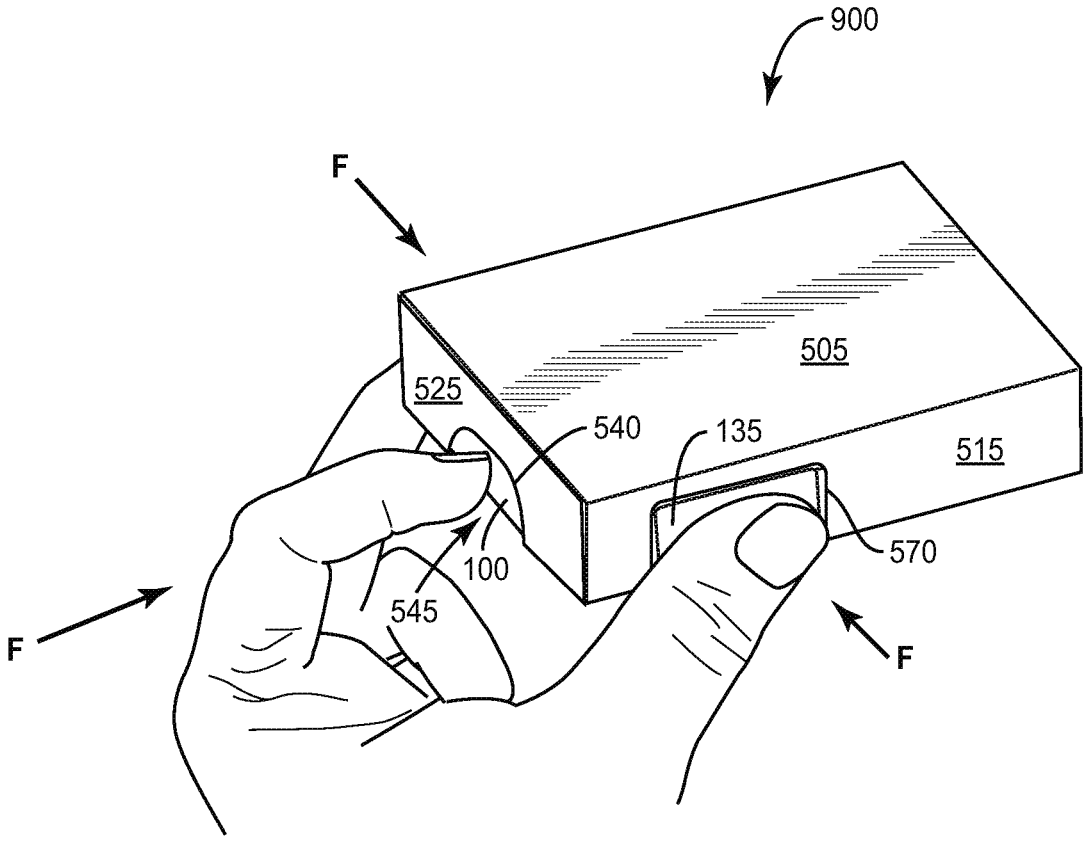
FIG. 14 is a perspective view of a child-resistant package demonstrating how to open the package, according to various embodiments.

Once the child-resistant package 900 is in the releasably locked state, the locking system may be disengaged as illustrated in FIG. 14 according to various embodiments. By way of example, a user may grasp the child-resistant package 900 in one hand and simultaneously apply forces at three separate points (as indicated by the arrows "F" in FIG. 14) to disengage the locking system. The user may apply forces to the locking tabs 135 with the thumb and middle finger such that the locking tabs 135 are held flush against the inner tray first and second side walls 110, 111. Simultaneously, the user may apply force with the index finger at the engagement point 545, which may urge the inner tray 100 forward and outward from the outer sleeve 500, thereby disengaging the locking system. As the index finger moves the inner tray 100 forward, the locking tabs 135 may again be sandwiched between the inner tray first and second side walls 110, 111 and the outer sleeve first and second side walls 515, 520 so that the forward movement of the inner tray 100 may continue until the first and second tethering panels 125, 555 engage.

Figure 15:
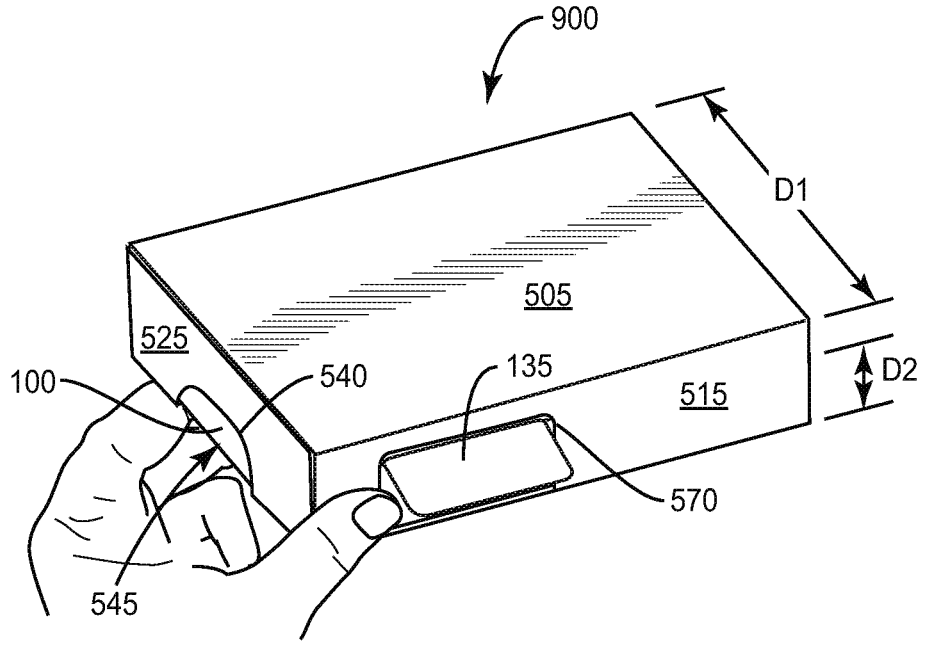
FIG. 15 is a perspective view of a child-resistant package demonstrating that a child's hand cannot open the package, according to various embodiments.

In order to further the child-resistant features of the child-resistant package 900, a distance between the locking slots 570 may be chosen such that a child's hand is not large enough to simultaneously apply force to both locking tabs 135 and the engagement point 545 as illustrated in FIG. 15. In various embodiments, the distance D1 between the locking slots 570 may be at least about 3 inches. In addition, a distance D2 of the vertical placement of the locking slots 570 from the lower panel 510 may further impede the ability of a child to simultaneously reach all three points of the locking system. In various embodiments, the distance D2 from the lower panel 510 may be at least about 0.5 inch.

Figure 16:
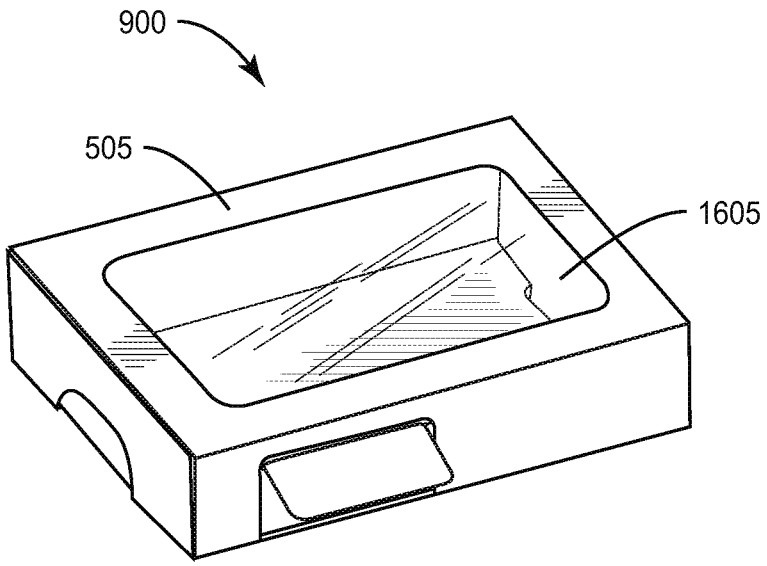
FIG. 16 is a perspective view of a child-resistant package with a window in the outer sleeve, according to various embodiments.
Figure 17:
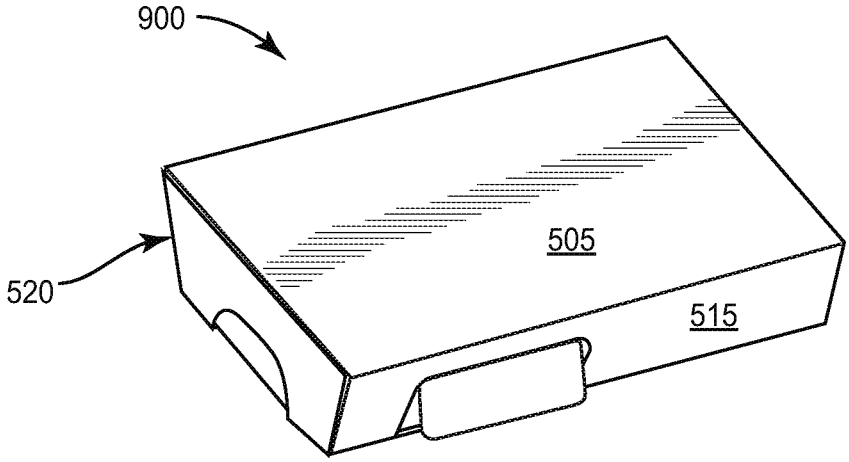
FIG. 17 is a perspective view of a child-resistant package with angled side walls, according to various embodiments.

Although the present disclosure has focused on a child-resistant package 900 having a generally regular rectangular box shape, one skilled in the art will readily recognize that a variety of shapes and features of the child-resistant package 900 are possible and are all within the scope of the present disclosure. FIGS. 16-20 illustrate exemplary, non-limiting embodiments of a variety of shapes and features of the child-resistant package 900. FIG. 16 illustrates a child-resistant package 900 with a window 1605 positioned in the outer sleeve upper panel 505 so that the contents of the child-resistant package 900 may be viewed without opening the child-resistant package 900. While only one window 1605 is shown, any number of windows 1605 may be placed in any position on any panel or side wall of the outer sleeve 500. FIG. 17 illustrates a child-resistant package 900 with angled first and second side walls 515, 520 (as opposed to first and second side walls 515, 520 generally perpendicular to the upper and lower panels 505, 510). Thus, the child-resistant package 900 may take on any desired shape, such as circular, oval, triangular, or any other regular or irregular shape.

Figure 18A:
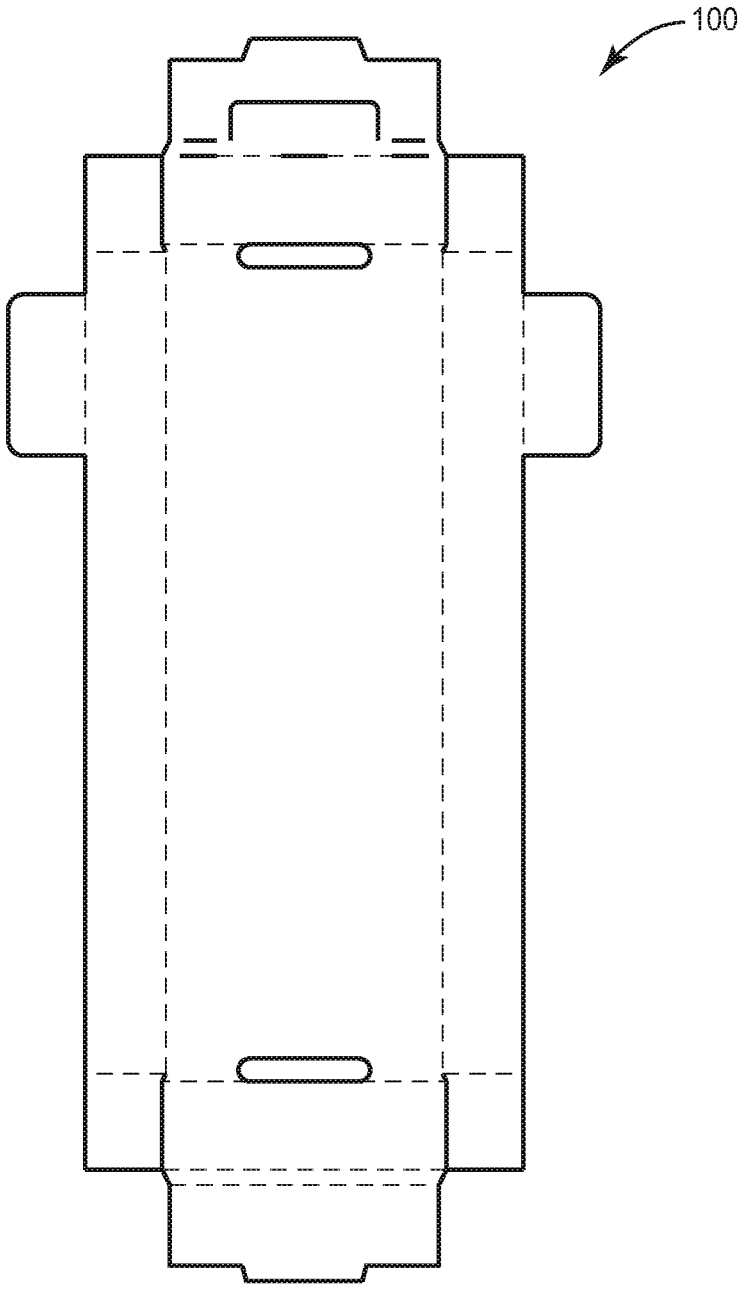
FIG. 18A is a plan view of an inner tray blank, according to various embodiments.
Figure 18B:
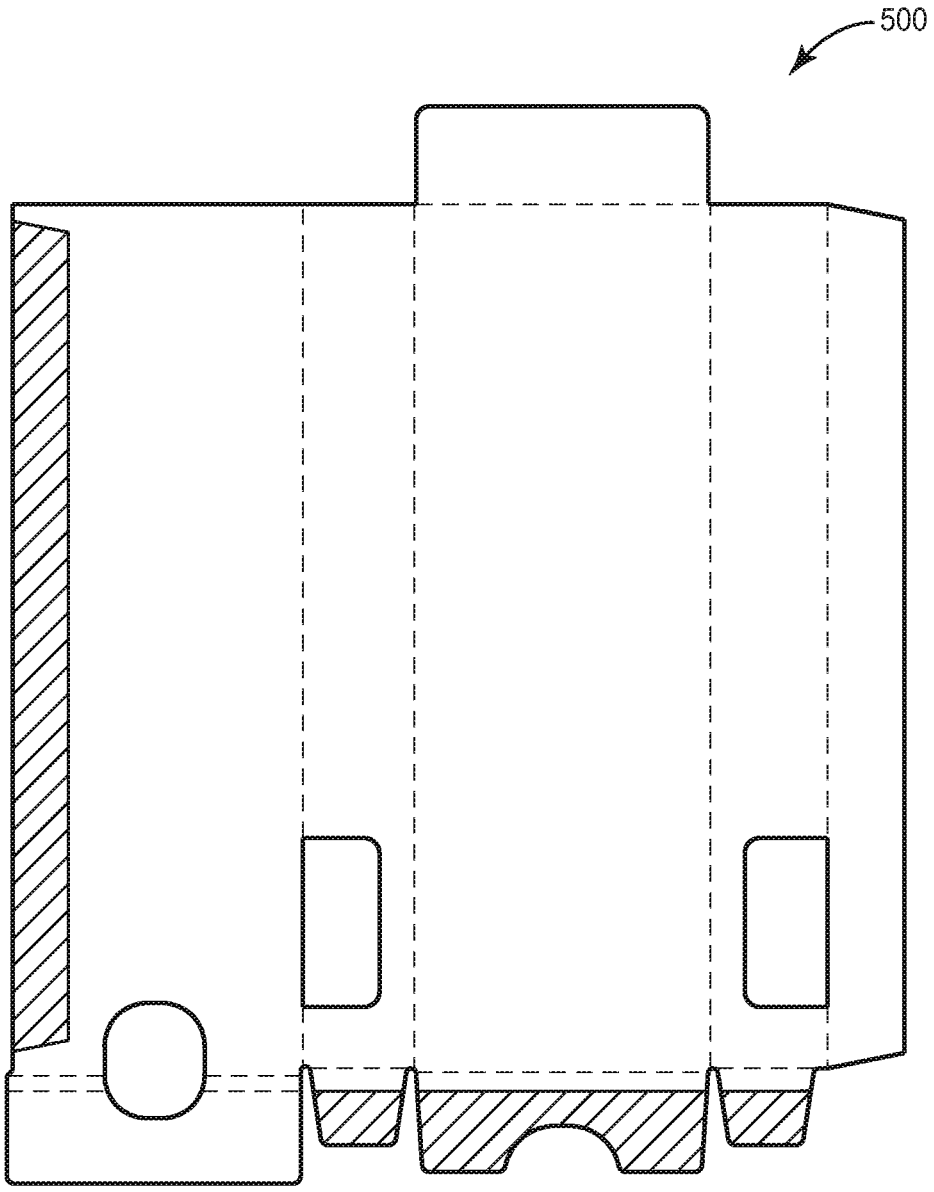
FIG. 18B is a plan view of an outer sleeve blank, according to various embodiments.
Figure 18C:
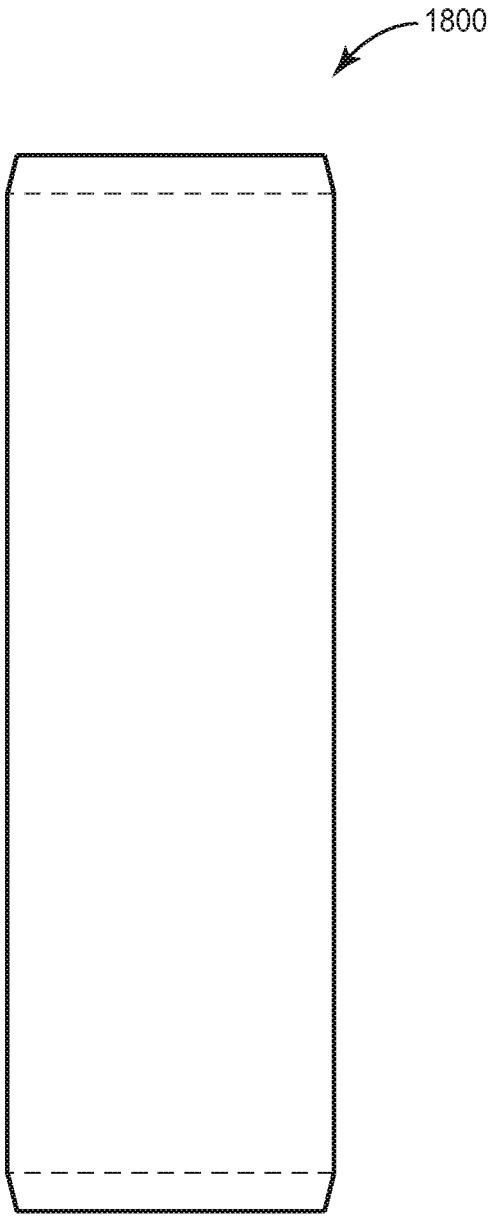
FIG. 18C is a plan view of an inner tray insert blank, according to various embodiments.

FIGS. 18A through 18C illustrate blanks for the inner tray 100, outer sleeve 500, and insert 1800, respectively, for a child-resistant package 900 with an elongated rectangular shape according to various embodiments. The insert 1800 may be used to line one or more surfaces of the inner tray 100.

Figure 19A:
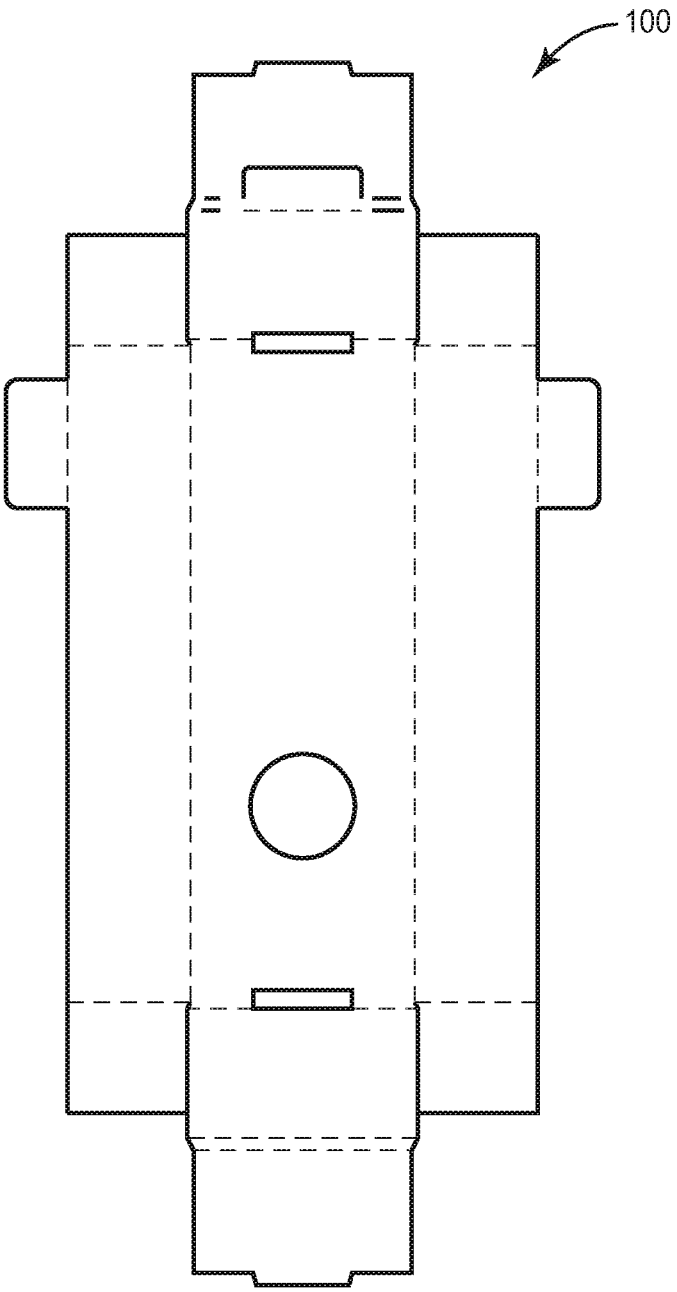
FIG. 19A is a plan view of an inner tray blank, according to various embodiments.
Figure 19B:
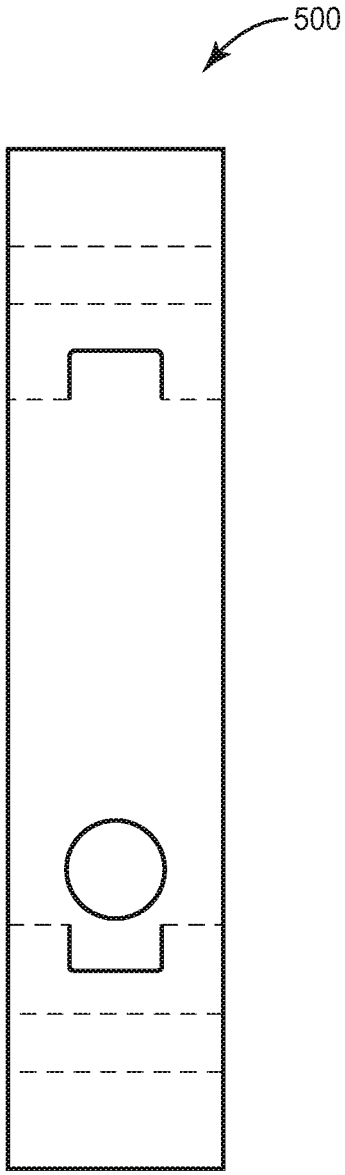
FIG. 19B is a plan view of an outer sleeve blank, according to various embodiments.

FIGS. 19A and 19B illustrate blanks for the inner tray 100 and outer sleeve 500, respectively, for a child-resistant package 900 in which the inner tray 100 comprises a hole to aid in dispensing a product from the inner tray 100.

Figure 20A:
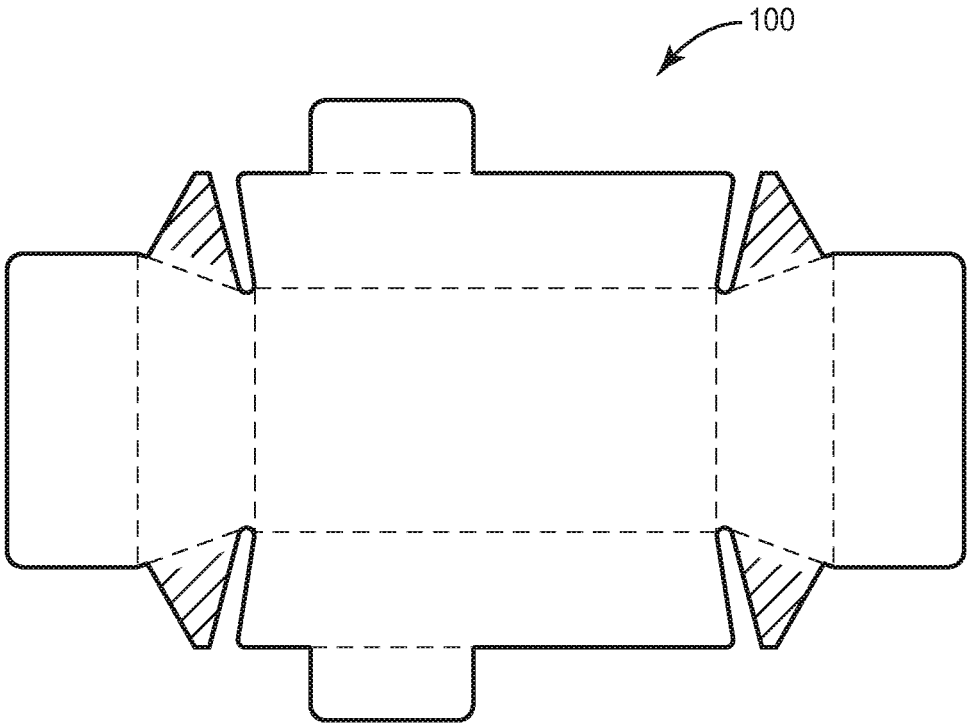
FIG. 20A is a plan view of an inner tray blank, according to various embodiments.
Figure 20B:
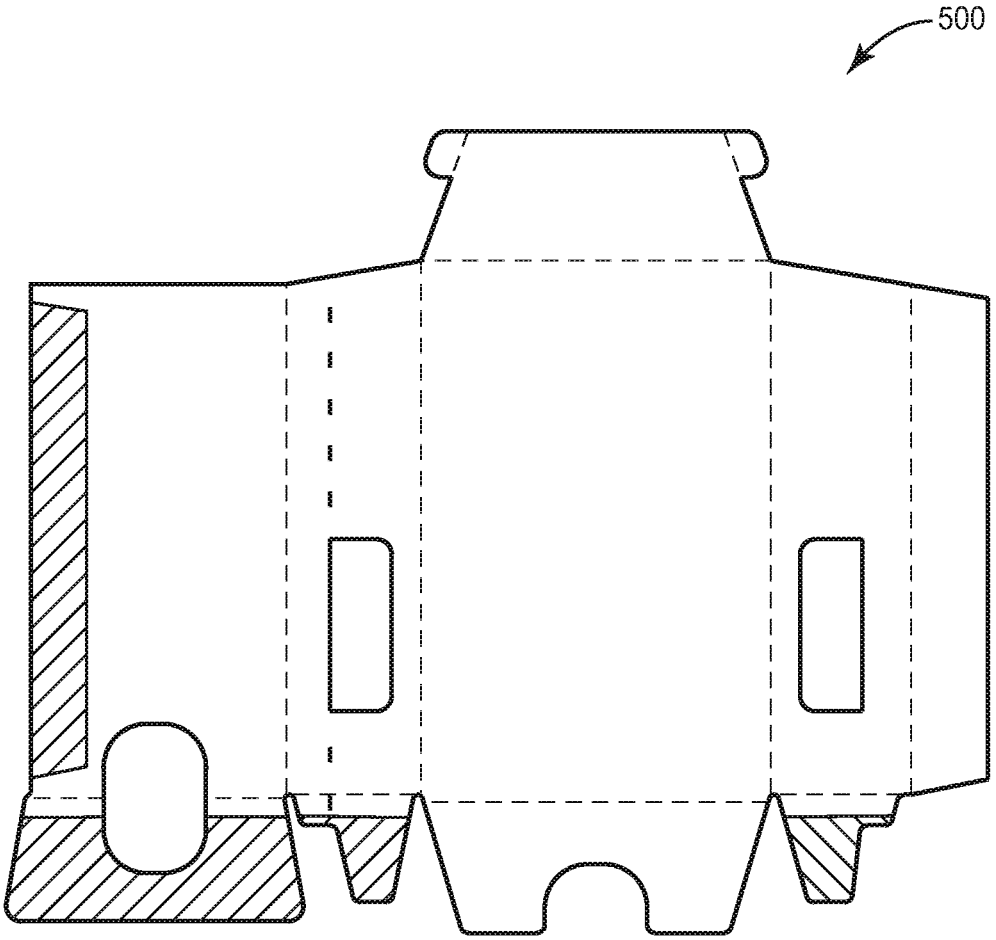
FIG. 20B is a plan view of an outer sleeve blank, according to various embodiments.
Figure 20C:
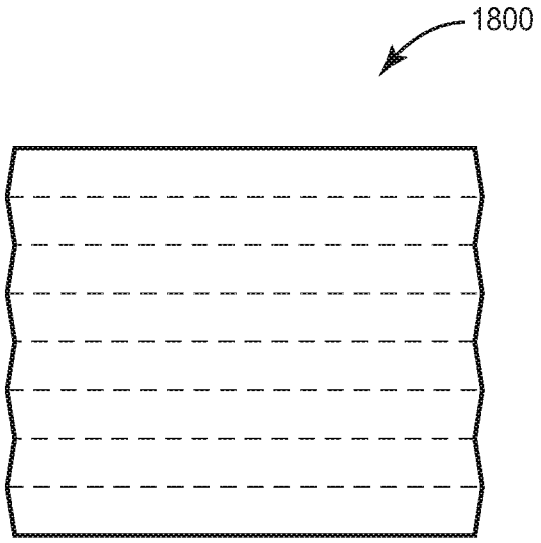
FIG. 20C is a plan view of an inner tray insert blank, according to various embodiments.

FIGS. 20A through 20C illustrate blanks for the inner tray 100, outer sleeve 500, and insert 1800, respectively, for the child-resistant package 900 with angled sides as illustrated in FIG. 17. The insert 1800 may have a corrugated shape useful for holding articles with an elongated, slender shape such as cigarettes, matches, and insulin injection syringes desirably stored in a child-resistant package 900.

Figure 21:
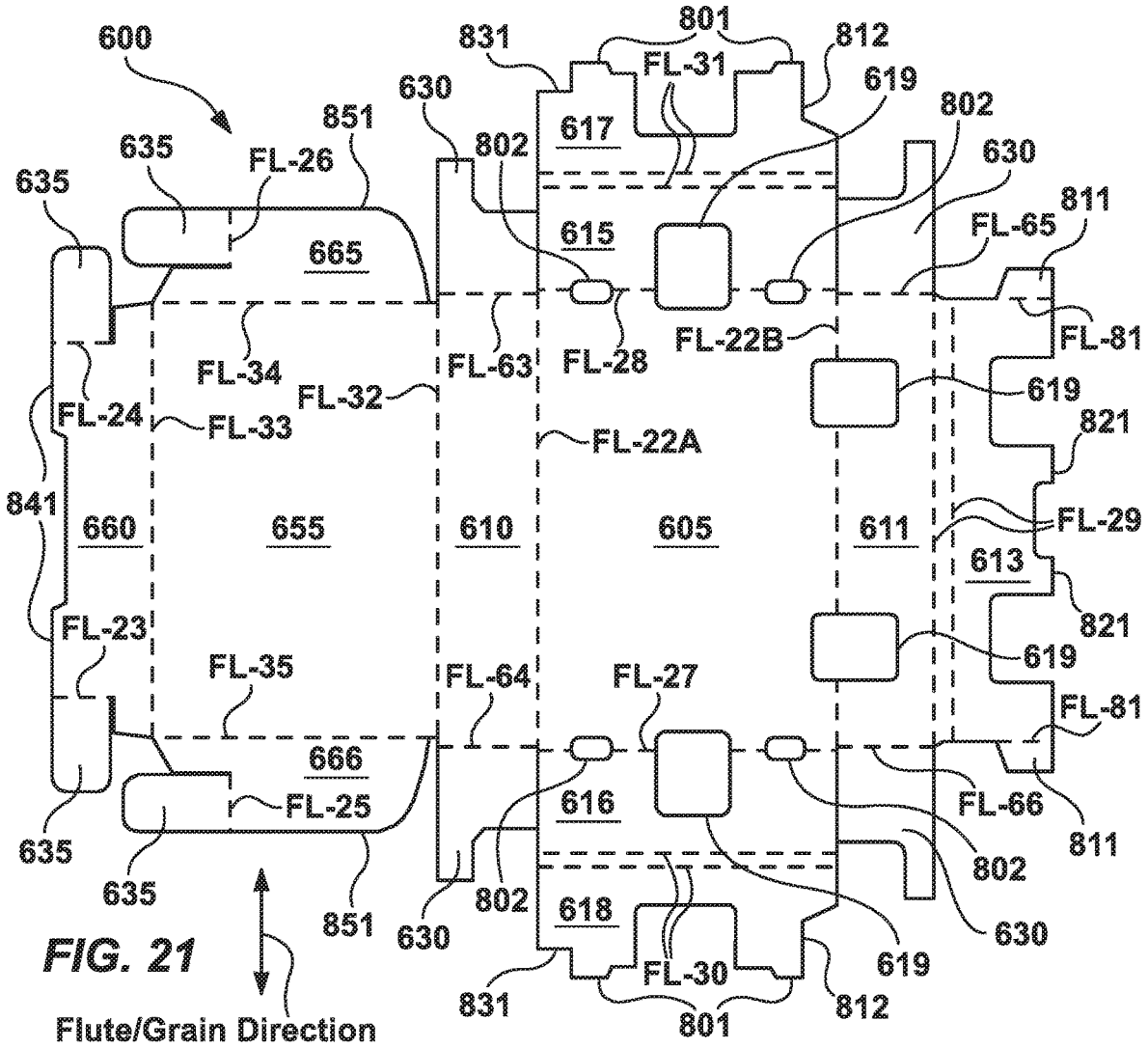
FIG. 21 is an exemplary plan view of a one piece child-resistant package die cut blank, according to various embodiments.

Various embodiments of the present disclosure may comprise a child-resistant package, and an engageable/disengageable locking system to secure the child-resistant package (see, for example, FIG. 33, FIG. 34, FIG. 35A, FIG. 35B, and FIG. 36). In various embodiments, the child-resistant package comprises a one piece child-resistant package. In some embodiments, a one piece child-resistant package is formed from a single piece of material that allows for the one piece child-resistant package to be formed efficiently without the use of glue or adhesive. For example, in some embodiments no glue or hand work is required to assemble the one piece child-resistant package. In contrast, a multi piece child-resistant package (e.g., separate inner tray and outer sleeve) may require glue and/or hand work to assemble the package. FIG. 21 illustrates an exemplary plan view of a one piece child-resistant package 600 die cut blank, according to various embodiments. The precise overall shape of the die cut blank, as well as the precise shape of each component of the die cut blank, may be varied for each particular use of a child-resistant package, as well as for design aesthetics. One skilled in the art will readily recognize that the shapes and specific components illustrated in this disclosure for the die cut blanks may have significant variability without departing from the scope of the disclosure. A bi-directional arrow labeled "Flute/Grain Direction" shows the flute direction for corrugated material and the grain direction for paperboard, according to various embodiments of the present technology. Exemplary fold lines may be illustrated with dotted lines. In some embodiments, fold lines illustrated with dotted lines in FIG. 21 may change to solid lines in various figures more clearly show the one piece child-resistant package 600 die cut blank forming into a child-resistant package with the engageable/disengageable locking system (see, for example, FIG. 33, FIG. 34, FIG. 35A, FIG. 35B, and FIG. 36).

Continuing with FIG. 21, according to various embodiments, the one piece child-resistant package 600 die cut blank may comprise a floor panel 605 coupled to opposing first side wall 610 and second side wall 611 along fold lines FL-22A and FL-22B, respectively. At each end of the first side wall 610, end tabs 630 may be coupled along fold lines FL-63 and FL-64, respectively. Similarly, end tabs 630 may be coupled to the second side wall 611 along fold lines FL-65 and FL-66, respectively. The floor panel 605 may also be coupled to opposing first end wall 615 and second end wall 616 along fold lines FL-28 and FL-27, respectively. The first end wall 615 and the second end wall 616 may comprise at least one locking slot 619. The at least one locking slot 619 of the first end wall 615 may be formed in part of the floor panel 605 and the first end wall 615. Similarly, the at least one locking slot 619 of the second end wall 616 may be formed in part of the floor panel 605 and the second end wall 616. The first end wall 615 and the second end wall 616 may further comprise double wall gaps 802. In various embodiments, the double wall gaps 802 of the first end wall 615 are formed in part of the floor panel 605 and the first end wall 615. Similarly, the double wall gaps 802 of the second end wall 616 are formed in part of the floor panel 605 and the second end wall 616. The first end wall 615 and the second end wall 616 may be coupled to first double wall panel 617 and second double wall panel 618 along fold lines FL-31 and FL-30, respectively. Fold lines FL-31 and FL-30 are illustrated with two dotted lines to represent double fold lines for formation of a double wall (see, for example, FIG. 35A and FIG. 35B). In various embodiments, double fold lines form a recessed locking slot (see, for example, FIG. 35A and FIG. 35B). The first double wall panel 617 and the second double wall panel 618 may each comprise double wall panel edges 801, double wall panel side edge 812, and double wall panel notch edge 831, respectively, (which may engage with parts of a support board 700 (shown in FIG. 22) and the one piece child-resistant package 600 to form a child-resistant package, as will become evident from the following figures and discussion).

Continuing with FIG. 21, according to various embodiments, the second side wall 611 may also be coupled to a third double wall panel 613 along fold line FL-29. Fold line FL-29 is illustrated with two dotted lines to represent double fold lines for formation of a double wall (see, for example, FIG. 35A and FIG. 35B). The third double wall panel 613 may comprise third double wall panel tabs 811 formed along fold lines FL-81. The third double wall panel 613 may further comprise third double wall panel edges 821 (which may engage with parts of the support board 700 and the one piece child-resistant package 600 to form a child-resistant package, as will become evident from the following figures and discussion). The second side wall 611 may further comprise at least one locking slot 619 that may be formed in part of the floor panel 605 and the second side wall 611.

Continuing with FIG. 21, according to various embodiments, the first side wall 610 may also be coupled to cover panel 655 along fold line FL-32. The cover panel 655 may be coupled to a first cover end wall 665 and a second cover end wall 666 along fold lines FL-34 and FL-35, respectively. The first cover end wall 665 and the second cover end wall 666 may be coupled to at least one locking tab 635 along fold lines FL-26 and FL-25, respectively. The first cover end wall 665 and the second cover end wall 666 may each comprise cover end wall edges 851 (which may engage with parts of the support board 700 and the one piece child-resistant package 600 to form a child-resistant package, as will become evident from the following figures and discussion).

Continuing with FIG. 21, according to various embodiments, the cover panel 655 may also be coupled to a cover side wall 660 along fold line FL-33. The cover side wall 660 may be coupled to at least one locking tab 635 along fold lines FL-24 and FL-23, respectively. The cover side wall 660 may comprise cover side wall edges 841 (which may engage with parts of the support board 700 and the one piece child-resistant package 600 to form a child-resistant package, as will become evident from the following figures and discussion).

Figure 22:
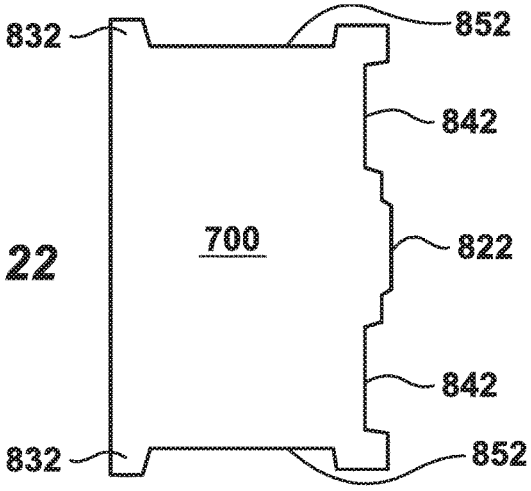
FIG. 22 is an exemplary plan view of a die cut blank of the support board for a child-resistant package, according to various embodiments.

FIG. 22 illustrates an exemplary plan view of a die cut blank of the support board 700 for a child-resistant package, according to various embodiments. The precise overall shape of the die cut blank, as well as the precise shape of each component of the die cut blank, may be varied for each particular use of the support board and the child-resistant package, as well as for design aesthetics. One skilled in the art will readily recognize that the shapes and specific components illustrated in this disclosure for the die cut blanks may have significant variability without departing from the scope of the disclosure. The die cut blank of the support board 700 shown in FIG. 22 may comprise support board panels 832, support board end wall edges 852, support board side wall edges 842, and support board side wall pyramid edge 822. As will become evident from the following figures and discussion, parts of the support board 700 of FIG. 22 (e.g., the support board panels 832, the support board end wall edges 852, the support board side wall edges 842, and the support board side wall pyramid edge 822) may interact with parts of the one piece child-resistant package 600 of FIG. 21 (e.g., the third double wall panel edges 821, the double wall panel notch edges 831, the cover side wall edges 841, and the cover end wall edges 851) to allow formation of a child-resistant package without using adhesive or glue. For example, in some embodiments no glue or hand work is required to assemble the one piece child-resistant package 600. In various exemplary embodiments, the support board panels 832 fit with the double wall panel notch edges 831, the support board end wall edges 852 fit with the cover end wall edges 851, the support board side wall edges 842 fit with the cover side wall edges 841, and the support board side wall pyramid edge 822 fits with the third double wall panel edges 821.

Figure 23:
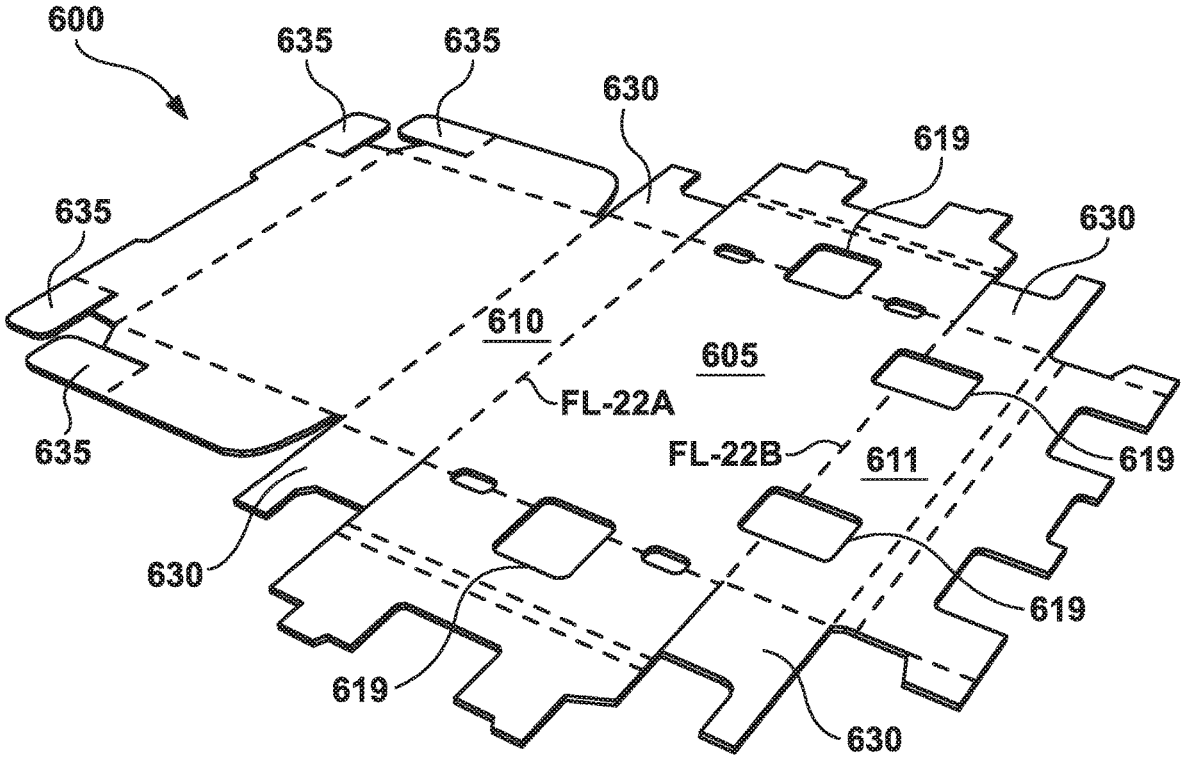
FIG. 23 is an exemplary perspective view of the one piece child-resistant package die cut blank in a flat position, according to various embodiments.

Now turning to FIG. 23, FIG. 23 illustrates an exemplary perspective view of the one piece child-resistant package 600 die cut blank in a flat position, according to various embodiments. The floor panel 605 may be coupled to the opposing first side wall 610 and the second side wall 611 along fold lines FL-22A and FL-22B, respectively. The at least one locking tab 635 and the at least one locking slot 619 are shown in the exemplary perspective view of FIG. 23. Further, the end tabs 630 are shown in the exemplary perspective view of the one piece child-resistant package 600.

Figure 24:
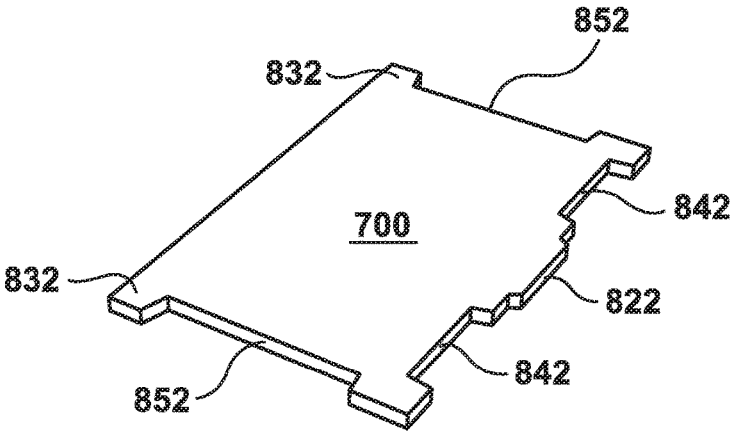
FIG. 24 is an exemplary perspective view of the support board for a child-resistant package, according to various embodiments.

FIG. 24 is an exemplary perspective view of the support board 700 for a child-resistant package, according to various embodiments. The support board 700 comprises the support board panels 832, the support board end wall edges 852, the support board side wall edges 842, and the support board side wall pyramid edge 822. As will become evident from the following figures and discussion, parts of the support board 700 of FIG. 24 (e.g., the support board panels 832, the support board end wall edges 852, the support board side wall edges 842, and the support board side wall pyramid edge 822) may interact with parts of the one piece child-resistant package 600 to allow formation of a child-resistant package without using adhesive and/or glue. For example, in some embodiments no glue or hand work is required to assemble the one piece child-resistant package 600.

Figure 25:
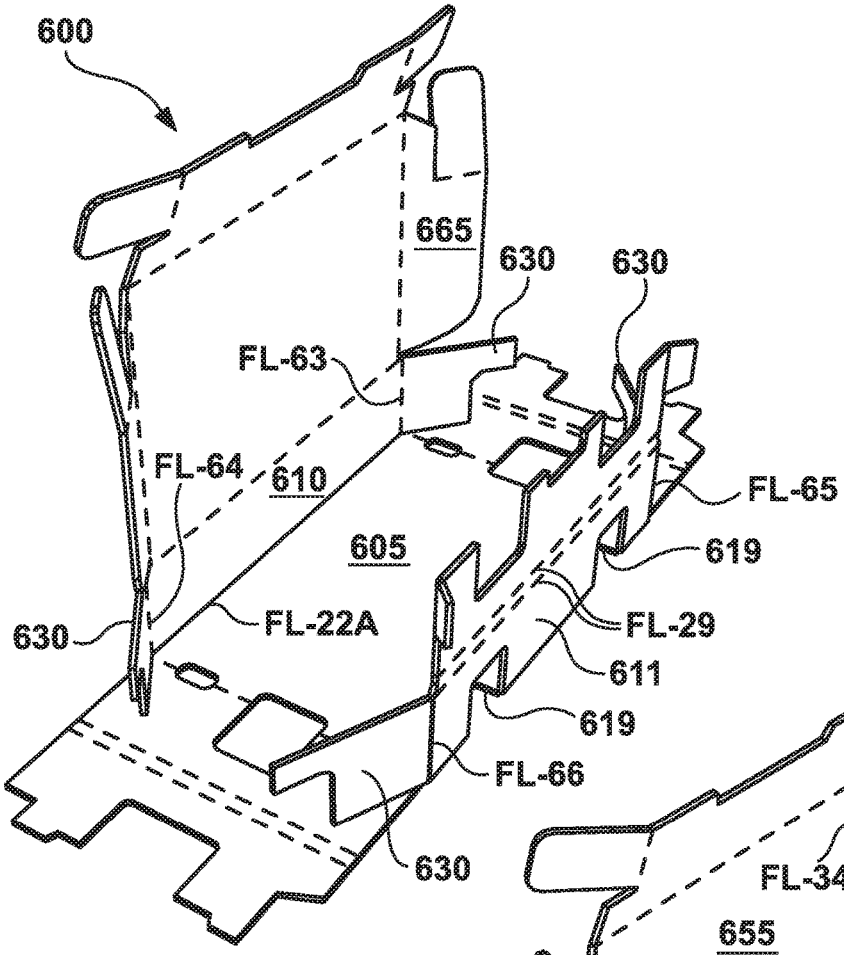
FIG. 25 is an exemplary perspective view of the one piece child-resistant package die cut blank being formed into a child-resistant package, according to various embodiments.

FIG. 25 is an exemplary perspective view of the one piece child-resistant package 600 die cut blank being formed into a child-resistant package, according to various embodiments. The floor panel 605 is coupled to the opposing first side wall 610 and the second side wall 611 along fold lines FL-22A (illustrated as a solid line) and FL-22B (not shown in the perspective view of FIG. 25), respectively. At each end of the first side wall 610, the end tabs 630 are shown beginning to form a double wall along fold lines FL-63 and FL-64. Similarly, the end tabs 630 of second side wall 611 are shown beginning to form a double wall along fold lines FL-65 and FL-66 (illustrated as solid lines). The second side wall 611 formed along fold line FL-22B (not shown in the perspective view of FIG. 25) illustrates the at least one locking slot 619 being formed in part of the floor panel 605 and the second side wall 611. Additionally, fold line FL-29 is shown in the perspective view of FIG. 25. Further, the first cover end wall 665 is shown moving into position to form a double wall.

Figure 26:
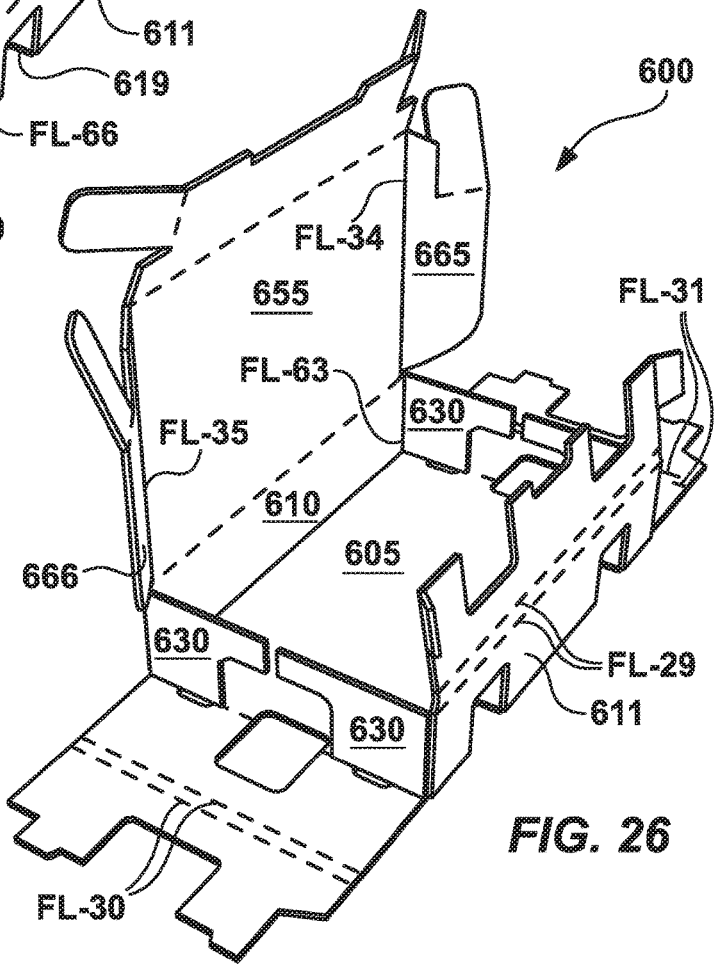
FIG. 26 is an exemplary perspective view of the one piece child-resistant package die cut blank being further formed into a child-resistant package, according to various embodiments.

FIG. 26 is an exemplary perspective view of the one piece child-resistant package 600 die cut blank being further formed into a child-resistant package, according to various embodiments. The floor panel 605 is coupled to the opposing first side wall 610 and the second side wall 611 along fold lines FL-22A and FL-22B (not shown in the perspective view of FIG. 26), respectively. At each end of the first side wall 610, the end tabs 630 are shown further forming a double wall along fold lines FL-63 (shown as a solid line) and FL-64 (not shown). Similarly, the end tabs 630 of second side wall 611 are shown further forming a double wall along fold lines FL-65 and FL-66 (not shown). The cover panel 655 is coupled to the first cover end wall 665 and the second cover end wall 666 along fold lines FL-34 and FL-35 (illustrated as solid lines), respectively. Further, fold lines FL-31 and FL-30 as well as fold line FL-29 are shown in the perspective view of FIG. 26.

Figure 27:
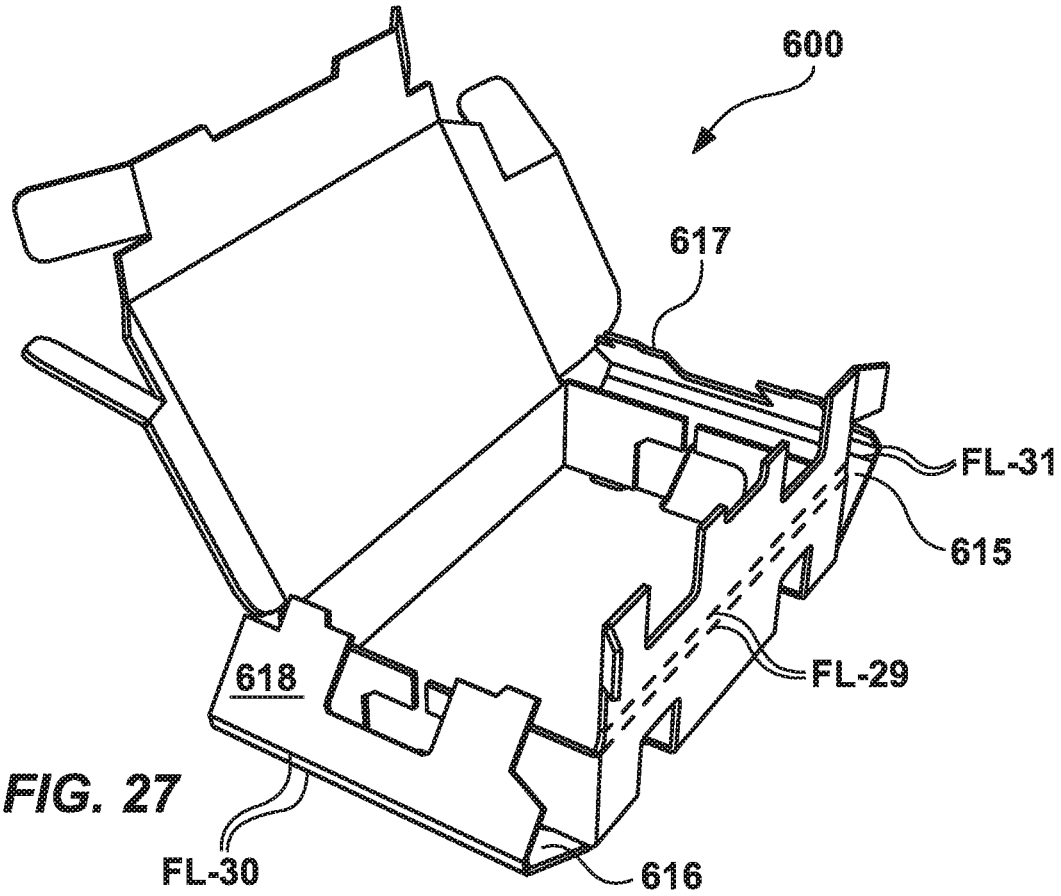
FIG. 27 is an exemplary perspective view of the one piece child-resistant package die cut blank further along the process of being formed into a child-resistant package, according to various embodiments.

FIG. 27 is an exemplary perspective view of the one piece child-resistant package 600 die cut blank further along the process of being formed into a child-resistant package, according to various embodiments. The first end wall 615 and the second end wall 616 are illustrated being folded with the first double wall panel 617 and the second double wall panel 618 along fold lines FL-31 and FL-30 (illustrated as solid lines), respectively, to each form a double wall. Fold line FL-29 is shown in the perspective view of FIG. 27.

Figure 28:
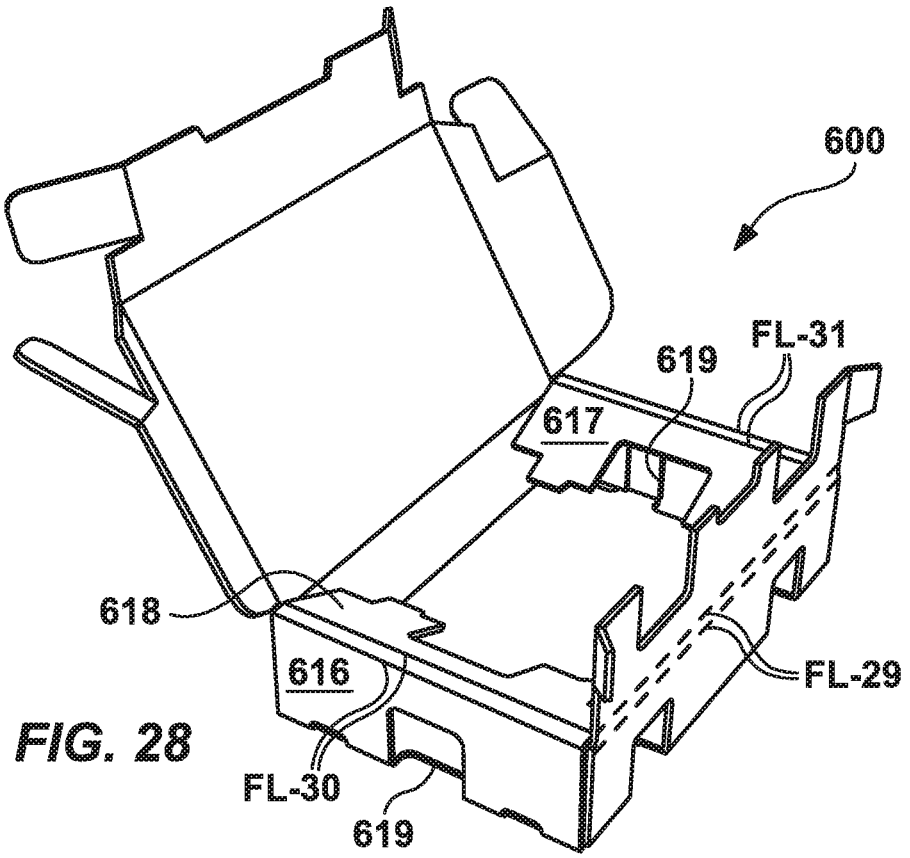
FIG. 28 is an exemplary perspective view of the one piece child-resistant package die cut blank further being formed into a child-resistant package, according to various embodiments.

FIG. 28 is an exemplary perspective view of the one piece child-resistant package 600 die cut blank further being formed into a child-resistant package, according to various embodiments. The first end wall (not shown) and the second end wall 616 are illustrated being folded with the first double wall panel 617 and the second double wall panel 618 along fold lines FL-31 and FL-30 (illustrated as solid lines), respectively, to each form a double wall. The at least one locking slot 619 is shown. In various embodiments, the at least one locking slot 619 is a recessed locking slot. Fold line FL-29 is shown in the perspective view of FIG. 28.

Figure 29:
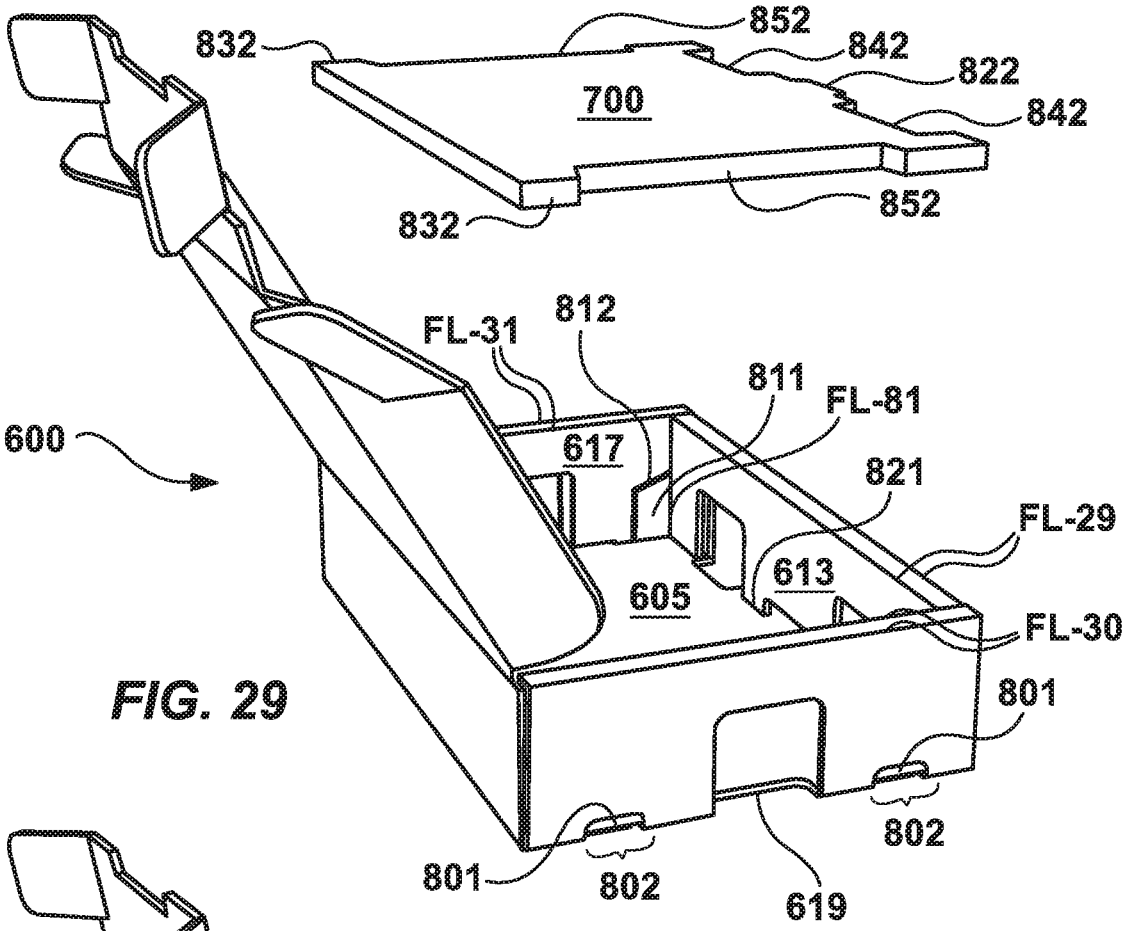
FIG. 29 is an exemplary perspective view of the one piece child-resistant package die cut blank further being formed into a child-resistant package and an exemplary perspective view of the support board for a child-resistant package, according to various embodiments.

FIG. 29 is an exemplary perspective view of the one piece child-resistant package 600 die cut blank further being formed into a child-resistant package, according to various embodiments. The floor panel 605 is visible in FIG. 29 because the floor panel 605 is not covered by the support board 700. The third double wall panel 613 is shown after being formed along fold line FL-29 (illustrated as solid lines). The third double wall panel 613 comprises the third double wall panel tabs 811 formed along fold lines FL-81 (illustrated as a solid line). The third double wall panel 613 is also shown with third double wall panel edges 821 in contact with the floor panel 605. The first double wall panel 617 and the second double wall panel (not shown) are illustrated folded along fold lines FL-31 and FL-30 (illustrated as solid lines), respectively, to form the at least one locking slot 619. Further, the double wall panel edges 801 are illustrated engaged with the double wall gaps 802.

Continuing with FIG. 29, FIG. 29 also includes is an exemplary perspective view of the support board 700 for a child-resistant package, according to various embodiments. The support board 700 comprises the support board panels 832, the support board end wall edges 852, the support board side wall edges 842, and the support board side wall pyramid edge 822. As will become evident from the following figures and discussion, parts of the support board 700 of FIG. 29 may interact with parts of the one piece child-resistant package 600 to allow formation of a child-resistant package without using adhesive and/or glue. For example, in some embodiments no glue or hand work is required to assemble the one piece child-resistant package 600.

Figure 30:
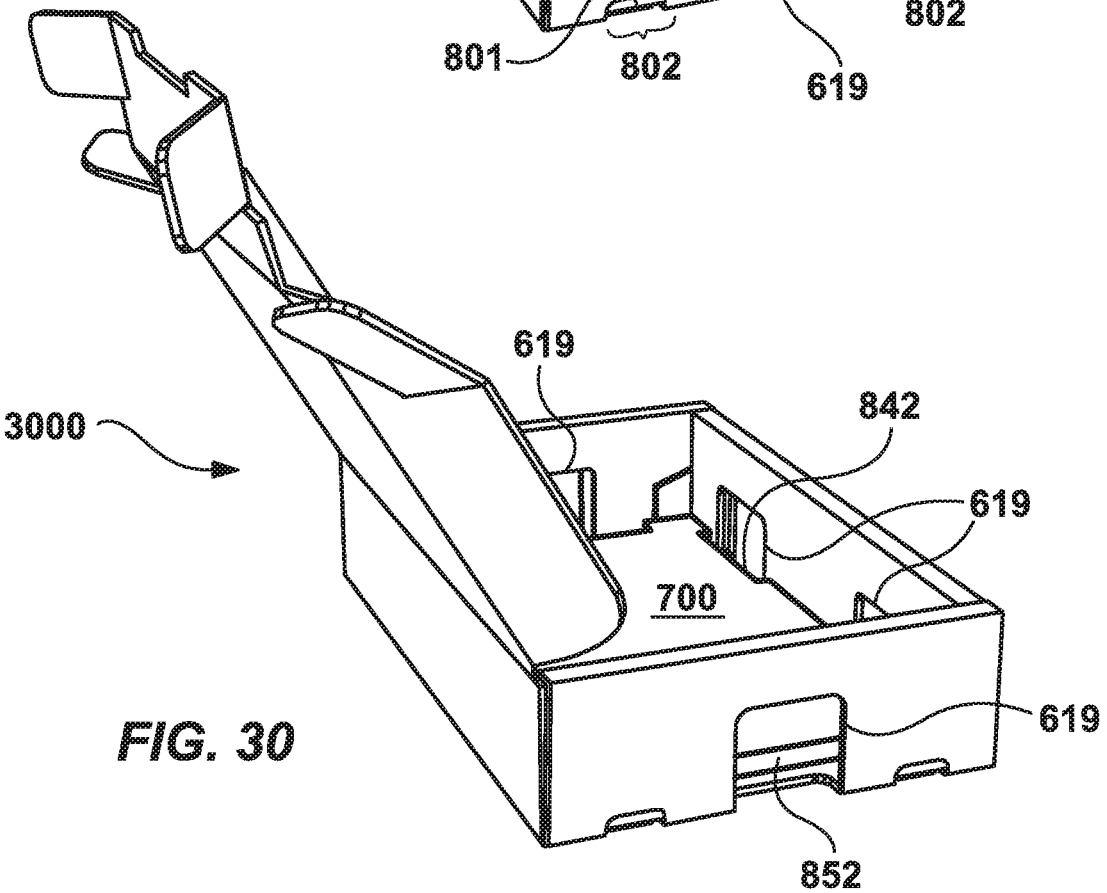
FIG. 30 is an exemplary perspective view of the one piece child-resistant package die cut blank being further formed into a child-resistant package, according to various embodiments.

FIG. 30 is an exemplary perspective view 3000 of the one piece child-resistant package 600 die cut blank being further formed into a child-resistant package, according to various embodiments. FIG. 30 illustrates the support board 700 placed into the one piece child-resistant package 600. In contrast to FIG. 29, the floor panel 605 is not visible in FIG. 30 because the floor panel 605 is covered by the support board 700. FIG. 30 illustrates the support board end wall edges 852, the support board side wall edges 842, and the at least one locking slot 619.

Figure 31:
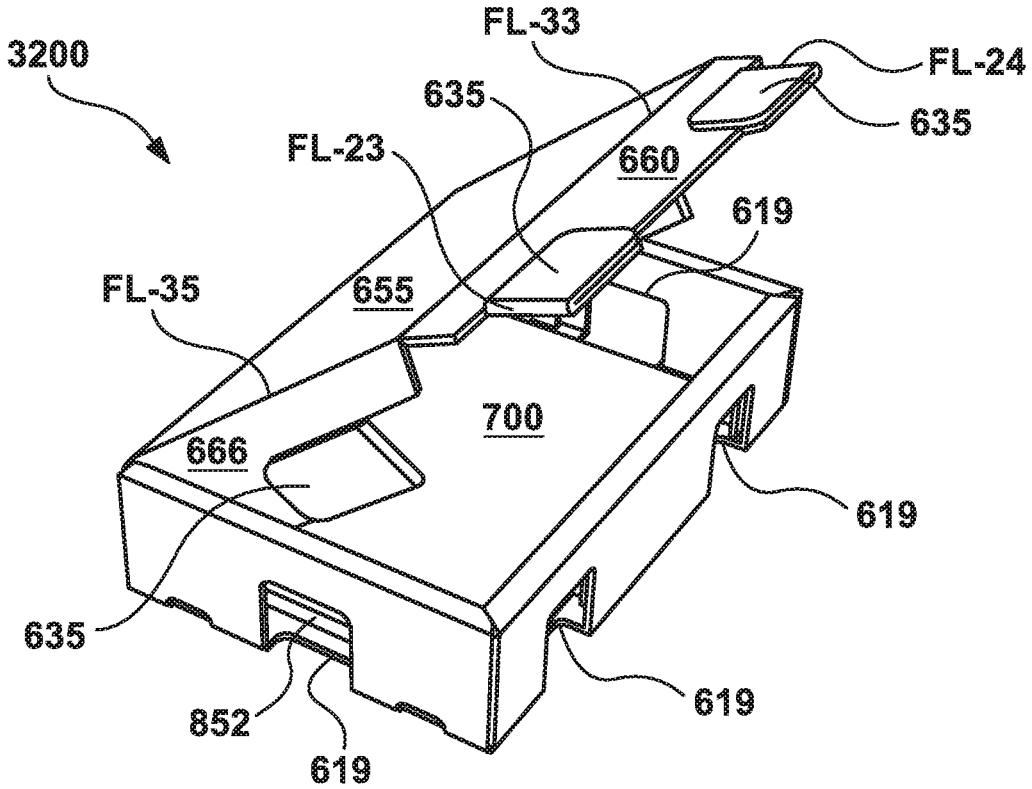
FIG. 31 is an exemplary perspective view of the one piece child-resistant package die cut blank further being formed into a child-resistant package, according to various embodiments.

FIG. 31 is an exemplary perspective 3200 view of the one piece child-resistant package 600 die cut blank further being formed into a child-resistant package, according to various embodiments. FIG. 31 illustrates the support board 700 placed in the one piece child-resistant package 600. The exemplary perspective view of FIG. 31 shows the at least one locking tab 635, the at least one locking slot 619, the support board 700, and the support board end wall edges 852. The cover panel 655 is shown coupled to a cover side wall 660 along fold line FL-33 (illustrated as a solid line) in an up position. The cover side wall 660 is shown coupled to at least one locking tab 635 along fold lines FL-24 and FL-23, (illustrated as solid lines). In various embodiments, fold lines FL-24 and FL-23, are folded against the flute direction for the corrugated material and against the grain direction for the paperboard. In various embodiments, the against the flute direction is greater than or equal to 5 degrees relative to the flute direction. In various embodiments, the against the grain direction is greater than or equal to 5 degrees relative to the grain direction. In some embodiments, the against the flute direction is substantially perpendicular to the flute direction. In some embodiments, the against the grain direction is substantially perpendicular to the grain direction. The against the flute direction and the against the grain direction may be any direction that results in Memory Properties for the at least one locking tab. The cover panel 655 is also illustrated coupled to the second cover end wall 666 along fold line FL-35 (illustrated as a solid line).

Figure 32:
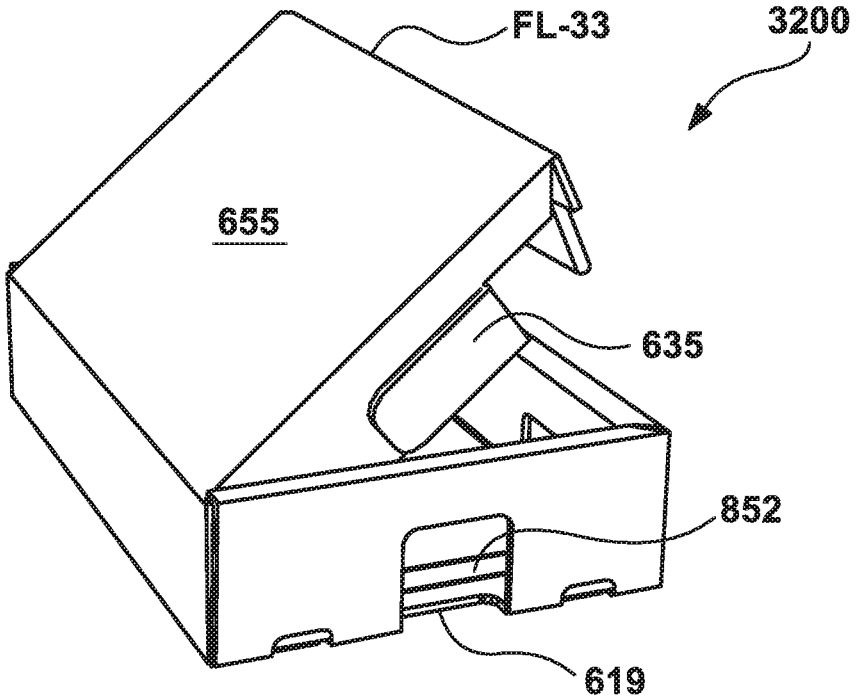
FIG. 32 is a perspective view of a one piece child-resistant package with a support board in an open or unlocked position, according to various embodiments.

FIG. 32 is another perspective view 3200 of a one piece child-resistant package with a support board 3200 in an open or unlocked position, according to various embodiments. The at least one locking tab 635, the at least one locking slot 619, and the support board end wall edges 852 are shown in the exemplary perspective view of FIG. 32. In various embodiments, the support board supports the at least one locking tab when the when the child-resistant package is in the locked position (not shown). The cover panel 655 is shown coupled to a cover side wall 660 (not shown) along fold line FL-33 (illustrated as a solid line) in a down position.

Figure 33:
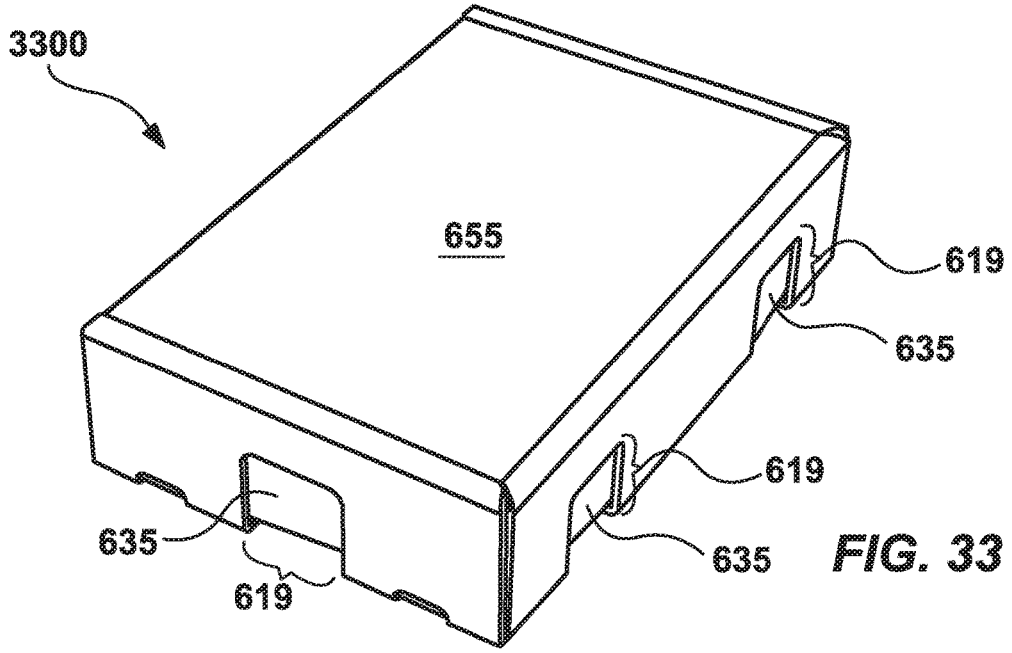
FIG. 33 is a perspective view of a one piece child-resistant package in a locked position, according to various embodiments.

FIG. 33 is a perspective view of a one piece child-resistant package in a locked position 3300, according to various embodiments. The at least one locking tab 635, and the at least one locking slot 619 are visible in the exemplary perspective view of FIG. 33. The engageable/disengageable locking system to secure a one piece child-resistant package in a locked position 3300 is shown with the at least one locking tab 635 engaged with the at least one locking slot 619 resulting in the cover panel 655 being in a closed or locked position.

Figure 34:
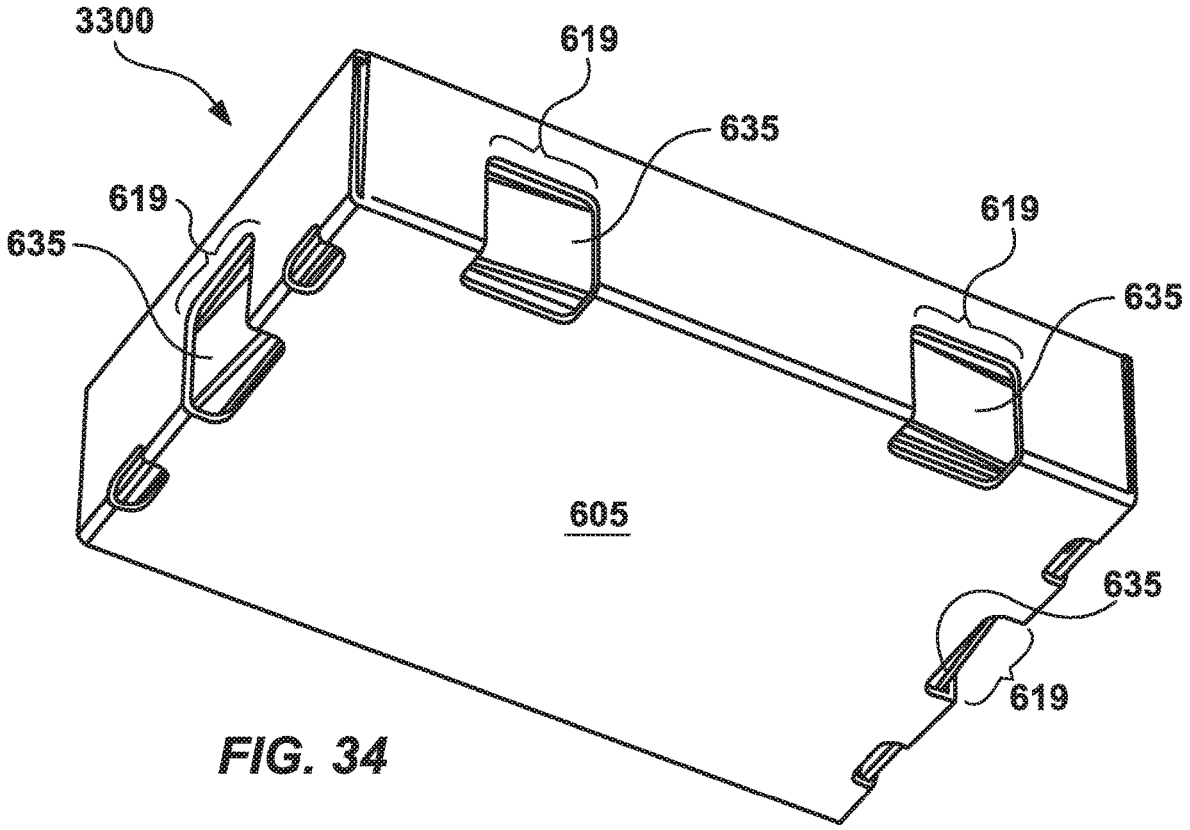
FIG. 34 is a bottom perspective view of the one piece child-resistant package in a locked position, according to various embodiments.

FIG. 34 is a bottom perspective view of the one piece child-resistant package in a locked position 3300, according to various embodiments. The at least one locking tab 635, and the at least one locking slot 619 are shown in the exemplary bottom perspective view of FIG. 34. The engageable/disengageable locking system to secure the child-resistant package is illustrated with the at least one locking tab 635 engaged with the at least one locking slot 619 (see, for example, FIG. 35A, FIG. 35B, and FIG. 36). In various embodiments, when the at least one locking tab 635, engages with the at least one locking slot 619 a "clicking" noise is made. In various embodiments, the at least one locking slot 619 is a recessed locking slot. The double wall panel edges 801 (not shown) are illustrated engaged with the double wall gaps 802 (not shown).

Figure 35A:
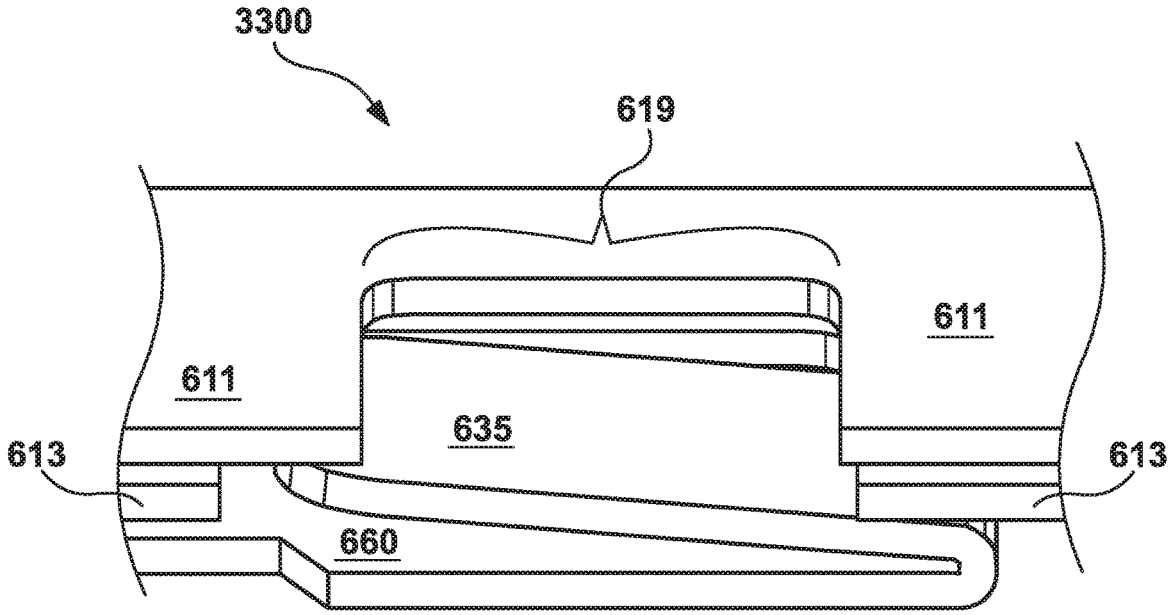
FIG. 35A is a close-up perspective view of the at least one locking tab engaged with the at least one locking slot of the one piece child-resistant package in a locked position, according to various embodiments.

FIG. 35A is a close-up perspective view of the at least one locking tab 635 engaged with the at least one locking slot 619 of the one piece child-resistant package in a locked position 3300, according to various embodiments. The at least one locking tab 635 is engaged with the at least one locking slot 619 of the engageable/disengageable locking system is shown. For example, the at least one locking tab 635 is shown coupled with the cover side wall 660. The third double wall panel 613 and the second side wall 611 are shown forming a double wall. In some embodiments, the double wall is formed from the third double wall panel 613 and the second side wall 611 to form the at least one locking slot 619. In various embodiments, the at least one locking slot 619 is a recessed locking slot. In some embodiments of the recessed locking slot, the second side wall 611 is shown blocking the at least one locking tab 635 from extending beyond the double wall of the child-resistant package. In various embodiments, double wall thickness may include an inner opening (e.g., formed from the third double wall panel 613) and an outer opening (e.g., formed from the second side wall 611). In some embodiments, the outer opening is smaller than the inner opening, which prevents the at least one locking tab 635 from extending beyond the boundary of a double wall. Preventing the at least one locking tab 635 from extending beyond the boundary of a double wall may prevent damage to the at least one locking tab 635, thus, making the engageable/disengageable locking system durable.

Figure 35B:
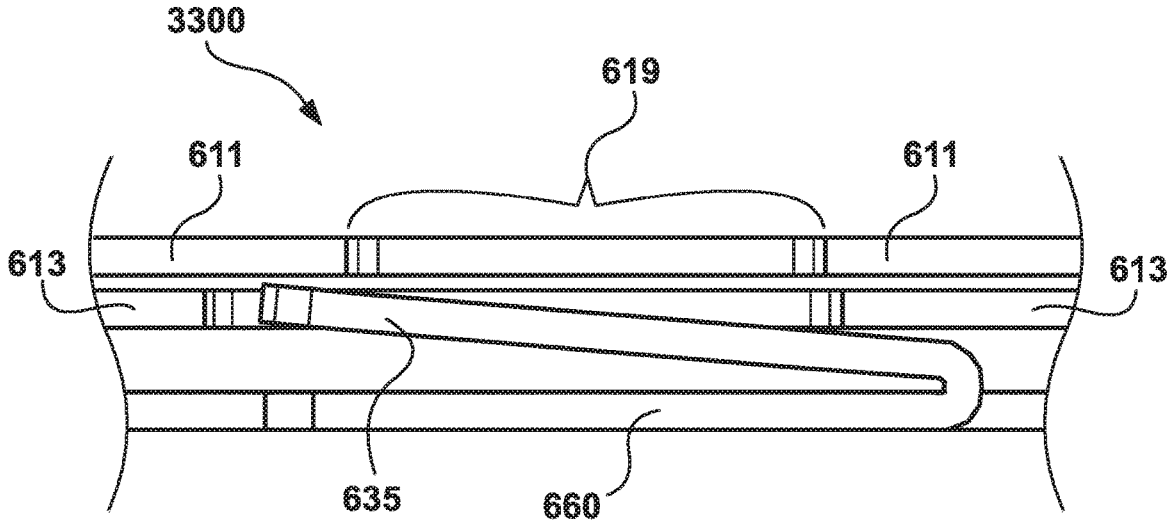
FIG. 35B is a close-up bottom view of the at least one locking tab engaged with the at least one locking slot of the one piece child-resistant package in a locked position, according to various embodiments.

FIG. 35B is a close-up bottom view of the at least one locking tab 635 engaged with the at least one locking slot 619 of the one piece child-resistant package in a locked position 3300, according to various embodiments. For example, see FIG. 34 for a bottom perspective view of the one piece child-resistant package in a locked position 3300. Again, the at least one locking tab 635 is engaged with the at least one locking slot 619 of the engageable/disengageable locking system is shown. For example, the at least one locking tab 635 is shown coupled with the cover side wall 660. The third double wall panel 613 and the second side wall 611 are shown forming a double wall. In some embodiments, the double wall is formed from the third double wall panel 613 and the second side wall 611 to form the at least one locking slot 619. In various embodiments, the at least one locking slot 619 is a recessed locking slot. In some embodiments of the recessed locking slot, the second side wall 611 is shown blocking the at least one locking tab 635 from extending beyond the double wall of the child-resistant package. In various embodiments, double wall thickness may include an inner opening (e.g., formed from the third double wall panel 613) and an outer opening (e.g., formed from the second side wall 611). In some embodiments, the outer opening is smaller than the inner opening, which prevents the at least one locking tab 635 from extending beyond the boundary of a double wall. Preventing the at least one locking tab 635 from extending beyond the boundary of a double wall may prevent damage to the at least one locking tab 635, thus, making the engageable/disengageable locking system durable.

Figure 36:
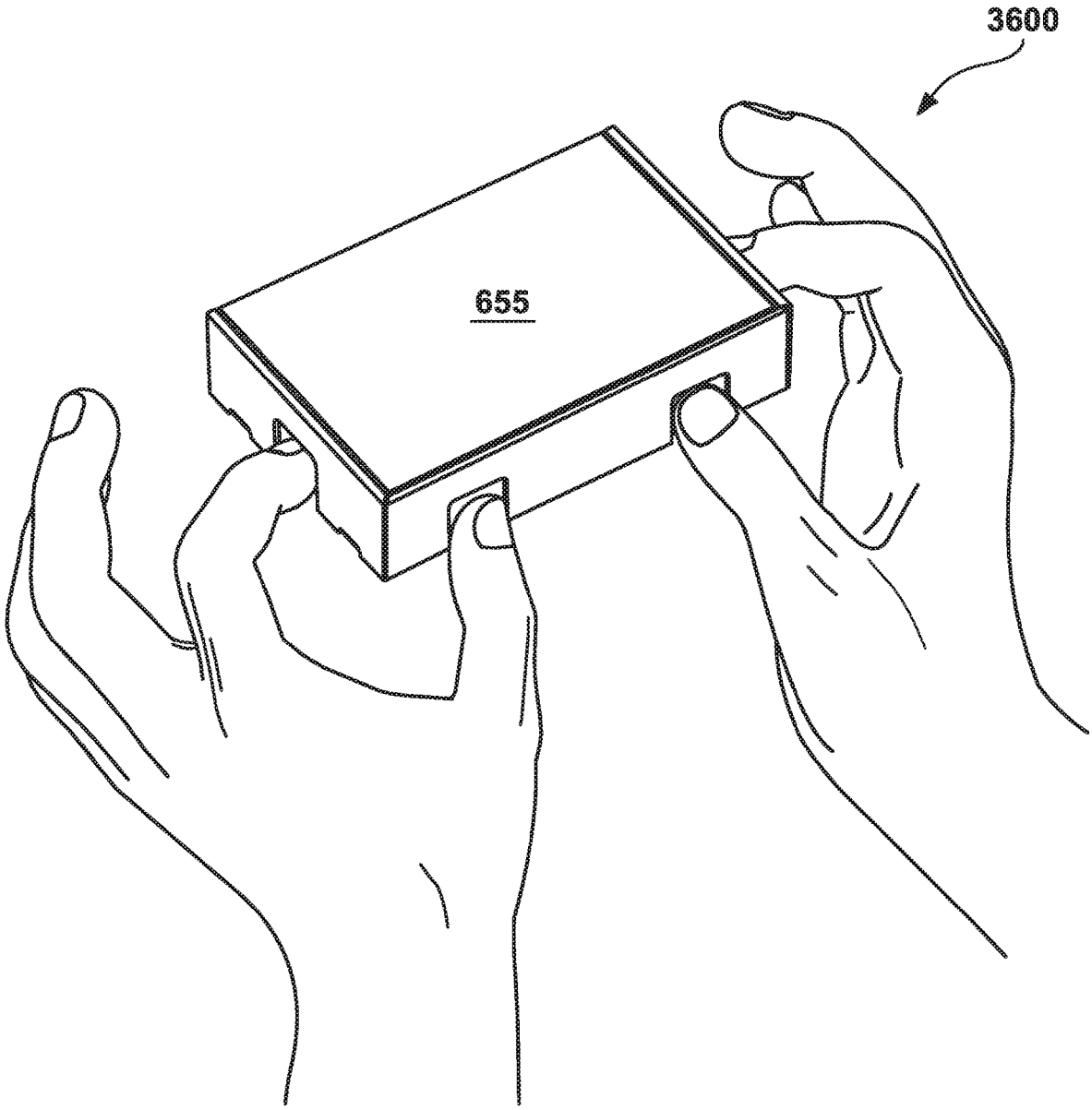
FIG. 36 is a perspective view of a child-resistant package in a locked position of the engageable/disengageable locking system, according to various embodiments.

FIG. 36 is a perspective view of a child-resistant package in a locked position 3600 of the engageable/disengageable locking system, according to various embodiments. The engageable/disengageable locking system secures the child-resistant package in a locked position 3600 by securing the cover panel 655. In some embodiments, side locking tabs (e.g., the at least one locking tab 635) and front locking tabs (e.g., the at least one locking tab 635) are shown releasable engaged with locking slots (e.g., the at least one locking slot 619), locking the child-resistant package 600. In various embodiments, opening the child-resistant package in a locked position 3600 requires simultaneous engagement of all of the locking tabs (i.e., the side locking tabs and the front locking tabs). For example, two hands may be used to simultaneously engage the side locking tabs and the front locking tabs. In order to further the child-resistant features of the child-resistant package 600, a distance between the side locking tabs (e.g., the at least one locking tab 635) and the front locking tabs (e.g., the at least one locking tab 635) may be chosen such that a child's hand is not large enough to simultaneously apply force to both the side locking tabs (e.g., the at least one locking tab 635) and the front locking tabs (e.g., the at least one locking tab 635) as illustrated in FIG. 36.

While various embodiments have been described above, it should be understood that they have been presented by way of example only, and not limitation. For example, although the present disclosure has focused on the child-resistant package 600 having a generally regular rectangular box shape, one skilled in the art will readily recognize that a variety of shapes and features of the child-resistant package 600 are possible and are all within the scope of the present disclosure. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A child-resistant package, comprising:

a package housing;

an insert that is received within the package housing; and a child-resistant locking system, comprising:

a locking tab, the locking tab being resiliently biased so as to engage with at least a portion of the package housing when in a locked configuration so as to prevent the insert from translating relative to the package housing;

wherein the locking tab further comprises a corrugated material, the corrugated material having flutes oriented in a flute direction; and the locking tab being resiliently biased in response to being bent against the flute direction.

2. The child-resistant package of claim 1, wherein the package housing further comprises an aperture;

wherein the locking tab is accessible through the aperture in the package housing.

3. The child-resistant package of claim 2, wherein the aperture is defined by an opening in a wall of the package housing, the locking tab contacting a portion of an outer peripheral edge of the opening to prevent the insert from translating.

4. The child-resistant package of claim 1, wherein the against the flute direction is greater than or equal to 5 degrees relative to the flute direction.

5. The child-resistant package of claim 1, wherein the against the flute direction is substantially perpendicular to the flute direction.

6. A child-resistant package, comprising:

a package housing;

an insert that is received within the package housing; and a child-resistant locking system, comprising:

a locking tab, the locking tab being resiliently biased so as to engage with at least a portion of the package housing when in a locked configuration so as to prevent the insert from translating relative to the package housing;

wherein the locking tab further comprises paperboard, the paperboard having a grain, the grain oriented in a grain direction; and the locking tab being resiliently biased in response to being bent against the grain direction.

7. The child-resistant package of claim 6, wherein the package housing further comprises an aperture;

wherein the locking tab is accessible through the aperture in the package housing.

8. The child-resistant package of claim 7, wherein the aperture is defined by an opening in a wall of the package housing, the locking tab contacting a portion of an outer peripheral edge of the opening to prevent the insert from translating.

9. The child-resistant package of claim 6, wherein the against the grain direction is greater than or equal to 5 degrees relative to the grain direction.

10. The child-resistant package of claim 6, wherein the against the grain direction is substantially perpendicular to the grain direction.

11. A child-resistant package, comprising:

a package housing; and a child-resistant locking system, comprising:

a locking tab, the locking tab being resiliently biased so as to engage with at least a portion of the package housing when in a locked configuration so as to prevent opening of the package housing;

wherein the locking tab further comprises a corrugated material, the corrugated material having flutes oriented in a flute direction; and the locking tab being resiliently biased in response to being bent against the flute direction.

12. The child-resistant package of claim 11, wherein the package housing further comprises a cover, the cover and the locking tab being a single piece of material;

wherein the cover engages with the locking tab when in the locked configuration so as to prevent opening of the package housing.

13. The child-resistant package of claim 11, wherein the package housing further comprises an aperture;

wherein the locking tab is accessible through the aperture in the package housing.

14. The child-resistant package of claim 13, wherein the aperture is defined by an opening in a wall of the package housing, the locking tab contacting a portion of the opening to prevent opening of the package housing.

15. A child-resistant package, comprising:

a package housing; and a child-resistant locking system, comprising:

a locking tab, the locking tab being resiliently biased so as to engage with at least a portion of the package housing when in a locked configuration so as to prevent opening of the package housing;

wherein the locking tab further comprises paperboard, the paperboard having a grain, the grain oriented in a grain direction; and the locking tab being resiliently biased in response to being bent against the grain direction.

16. The child-resistant package of claim 15, wherein the package housing further comprises a cover, the cover and the locking tab being a single piece of material;

wherein the cover engages with the locking tab when in the locked configuration so as to prevent opening of the package housing.

17. The child-resistant package of claim 15, wherein the package housing further comprises an aperture;

wherein the locking tab is accessible through the aperture in the package housing.

18. The child-resistant package of claim 17, wherein the aperture is defined by an opening in a wall of the package housing, the locking tab contacting a portion of the opening to prevent opening of the package housing.

19. The child-resistant package of claim 15, wherein the against the grain direction is greater than or equal to 5 degrees relative to the grain direction.

20. The child-resistant package of claim 15, wherein the against the grain direction is substantially perpendicular to the grain direction.

21. A child-resistant package, comprising:

a package housing;

an insert that is received within the package housing;

a releasable child-resistant locking system, comprising:

a locking tab, the locking tab comprising memory properties, the memory properties including the locking tab returning to a locked position after being in an unlocked position;

a locking slot, the locking slot engaging with the locking tab in the locked position preventing the insert from translating relative to the package housing;

the memory properties allowing the locking tab to releasably engage with the locking slot to allow the insert to translate relative to the package housing in the unlocked position, the memory properties being enhanced by folding the locking tab along a fold line; and an engagement point on the insert, and disengagement of the releasable child-resistant locking system requiring simultaneous application of force to the locking tab and the engagement point such that the locking tab disengages from the locking slot allowing the insert to translate relative to the package housing.

22. The package of claim 21, wherein the memory properties orient the locking tab at an angle greater than 0 degrees and less than 90 degrees relative to a side wall of the package housing.

23. The child-resistant package of claim 21, wherein:

the insert further comprises opposing side walls and opposing end walls disposed between the opposing side walls;

the package housing further comprises an opening adapted to receive the insert therein, and an end panel opposite the opening; and wherein the engagement point on the insert is on an insert end wall of the opposing end walls.

24. The child-resistant package of claim 23, wherein the locking tab is hingedly coupled to an insert side wall of the opposing side walls and angularly disposed to the insert side wall.

25. The child-resistant package of claim 21, wherein the locking tab comprises paperboard.

26. The child-resistant package of claim 25, wherein thickness of the paperboard is from between 0.012 inches and 0.030 inches.

27. The child-resistant package of claim 21, wherein the locking tab comprises plastic materials.

28. The child-resistant package of claim 21, wherein the locking tab comprises synthetic materials.

* * * * *